US006405969B1

(12) United States Patent
Ogren et al.

(10) Patent No.: US 6,405,969 B1
(45) **Date of Patent: *Jun. 18, 2002**

(54) CORELESS ADHESIVE TAPE WINDING MANDREL AND METHOD

(75) Inventors: Harvey D. Ogren, Dellwood; Jeffery N. Jackson; Dee Lynn Johnson, both of Woodbury; David R. Cram, Brainerd, all of MN (US)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/514,621

(22) Filed: Feb. 28, 2000

Related U.S. Application Data

(63) Continuation of application No. 09/026,859, filed on Feb. 20, 1998, now abandoned, which is a division of application No. 08/851,487, filed on May 5, 1997, now abandoned, which is a continuation of application No. 08/473,285, filed on Jun. 7, 1995, now abandoned.

(51) Int. Cl.[7] ..... B65H 18/08

(52) U.S. Cl. ..... 242/530.4; 242/527.2; 242/530.3; 242/529; 242/531

(58) Field of Search ..... 242/527.2, 530.3, 242/530.4, 529, 531, 534, 534.2; 156/184, 192

(56) References Cited

U.S. PATENT DOCUMENTS 1,441,543 A 6/1923 Tainsh (List continued on next page.)

FOREIGN PATENT DOCUMENTS

| | | |
|---|---|---|
| CA | 738251 | 7/1966 |
| CA | 1 084 473 | 8/1980 |
| DE | 225 247 | 5/1910 |
| DE | 22 44 190 | 3/1974 |
| DE | 32 39 661 A1 | 3/1984 |
| DE | 41 16 963 A1 | 11/1992 |
| DE | 44 10 862 A1 | 5/1995 |
| EP | 0 031 298 B1 | 3/1983 |
| EP | 0 618 159 A2 | 10/1994 |
| FR | 2 351 901 | 12/1977 |
| GB | 991368 | 5/1965 |
| GB | 1327368 | 8/1973 |
| GB | 2 029 930 A | 3/1980 |
| JP | 60 082576 | 10/1985 |
| JP | 7003227 | 1/1995 |

*Primary Examiner*—John Q. Nguyen
(74) *Attorney, Agent, or Firm*—David B. Patchett

(57) ABSTRACT

A method and apparatus of forming coreless rolls of pressure sensitive adhesive tape involves the use of a mandrel assembly having a specific circumferential tape supporting segment thereon for winding tape. The circumferential tape supporting segment has a tape engaging surface portion that, in a radial orientation, is compressible yet sufficiently stiff to support the tape as it is successively wound about the mandrel to form a tape roll, and that is sufficiently pliant to permit ready axial removal of a wound tape roll from the shaft. The innermost wrap of pressure sensitive adhesive tape about the mandrel is masked by an adhesive liner. That liner is formed from one portion of a liner/tab segment which had been applied to the tape previously, and prior to winding, the tape is severed, and the remainder of that liner/tab forms an end tab on the outermost end of the previously formed coreless tape roll.

11 Claims, 20 Drawing Sheets

U.S. PATENT DOCUMENTS

| | | | | |
|---|---|---|---|---|
| 1,885,587 | A | | 11/1932 | Burton |
| 1,950,738 | A | | 3/1934 | Mills ..... 263/55 |
| 2,608,503 | A | | 8/1952 | Meyer ..... 154/118 |
| 2,693,918 | A | | 11/1954 | Bretson et al. |
| 2,695,139 | A | | 11/1954 | Horvath ..... 242/63 |
| 2,772,774 | A | | 12/1956 | Rabuse |
| 2,787,941 | A | | 4/1957 | Aldrich et al. ..... 93/1 |
| 3,013,367 | A | | 12/1961 | La Sarre ..... 53/3 |
| 3,241,739 | A | | 3/1966 | Ahlemeyer ..... 239/51 |
| 3,633,839 | A | | 1/1972 | Clark ..... 242/36 R |
| 3,770,542 | A | | 11/1973 | Hall et al. ..... 156/184 |
| 3,823,887 | A | | 7/1974 | Gerstein ..... 242/56.2 |
| 3,899,075 | A | | 8/1975 | Hall et al. ..... 206/411 |
| 4,014,734 | A | | 3/1977 | Patterson ..... 156/459 |
| 4,297,403 | A | | 10/1981 | Smith ..... 428/42 |
| 4,339,294 | A | | 7/1982 | Jones ..... 156/252 |
| 4,757,950 | A | | 7/1988 | Rodriguez ..... 242/56 |
| 4,783,015 | A | | 11/1988 | Shimizu ..... 242/1 |
| 4,807,825 | A | | 2/1989 | Elsner et al. ..... 242/56 B |
| 5,022,597 | A | * | 6/1991 | Morizzo ..... 242/413.5 |
| 5,092,533 | A | | 3/1992 | Gangemi ..... 242/56.8 |
| 5,362,013 | A | | 11/1994 | Gietman, Jr. et al. ..... 242/521 |
| 5,366,174 | A | | 11/1994 | Tsukamoto et al. ..... 242/532.1 |
| 5,453,141 | A | | 9/1995 | Rodriguez ..... 156/184 |
| 5,620,544 | A | * | 4/1997 | Cram et al. ..... 242/532 X |

* cited by examiner

CORELESS ADHESIVE TAPE WINDING MANDREL AND METHOD

This application is a Continuation of Ser. No. 09/026,859 Feb. 20, 1998, abandoned which is a Divisional of Ser. No. 08/851,487 May 5, 1997, abandoned which is a Continuation of Ser. No. 08/473,285 Jun. 7, 1995, abandoned.

BACKGROUND OF THE INVENTION

The invention relates to a process and apparatus for forming coreless rolls of pressure sensitive adhesive tape.

There are many known methods and apparatus for forming individual spools or rolls of web material. The web material is often supplied in bulk in roll form, which is then unrolled, slit longitudinally and wound into individual strips of web material about a plurality of pre-aligned cores of cardboard or plastic. In the case of pressure sensitive adhesive tape, for example, typical cores are formed of paper, cardboard or plastic. Because it is useful to provide such tape in different widths, an inventory of cores of different widths is thus also required. The winding of tape onto a core necessitates additional material handling (e.g., core loading) during the tape roll production process. In addition, it is imperative during tape roll production that there be no misalignment between the core and the advancing strip of web material during winding. Misalignment can cause tape telescoping during winding or an axial offset winding of the tape onto the core ("off core" winding), both of which can lead to product aesthetic issues and dispensing difficulties.

The use of a core presents additional material inventory scheduling and storage requirements, and results in extra shipping weight and volume for the tape roll product. In addition, the cost of the core itself, particularly for shorter length tape rolls, can represent a significant proportion. of the product's cost. Further, the disposal of the core may present waste and environmental concerns when the supply of tape from the core has been depleted. Even if the core is formed from a material or composite that is recyclable, its use requires additional handling by the user in order to be salvaged for reuse or reprocessing. Under certain conditions over time (e.g., variable humidity and temperature), the discontinuity between the different core and wound tape materials can cause deformations to occur in the tape rolls, such as rippling or bulging, which are aesthetically undesirable.

Coreless rolls of pressure sensitive adhesive tape have been developed, along with processes for winding such rolls. One such process is disclosed in Hall et al. U.S. Pat. Nos. 3,770,542 and 3,899,075. A diametrically expandable and retractable mandrel is used for winding pressure sensitive adhesive tape thereon. Tape winding is initiated on this mandrel by leaving exposed a short segment of adhesive at the leading end of the tape. A next segment of the adhesive on the tape is covered with a backing sheet which presents a non adhesive surface to the mandrel for the remainder of the innermost wrap of tape about the mandrel. After a desired length of tape has been wound into a roll on this mandrel (in its expanded state), the tape is cut, winding stopped and the mandrel diametrically retracted. Rotation in an opposite relative direction between the mandrel and the tape then folds back the short adhesive bearing leading edge segment onto the backing sheet, thereby leaving no adhesive exposed on the innermost wrap of the tape roll. While this process results in a coreless roll of pressure sensitive adhesive tape, it is necessary to periodically stop the advance of web material through the apparatus for indexing purposes during tape roll production, thereby inhibiting high speed and continuous manufacturing of a coreless tape product. In addition, the further processing on the tape roll (rotation reversal of the mandrel relative to the roll) is necessary in order to fully achieve an innermost wrap of the tape roll which is free of adhesive. As mentioned, this process also requires a mandrel which expands and contracts diametrically. A pneumatically expandable mandrel is disclosed, which, of course, requires pneumatic couplings and presents a more complex and expensive mandrel arrangement than desired.

SUMMARY OF THE INVENTION

The present invention includes a method of sequentially forming a plurality of coreless rolls of pressure sensitive adhesive tape, and apparatus therefore. The inventive method includes providing a first rotating winding mandrel in a first winding station, directing a leading edge of an advancing strip of pressure sensitive adhesive tape around and directly against the first mandrel, and winding the tape successively upon itself and the first mandrel to form an in process coreless tape roll. The first mandrel and in process coreless tape roll are advanced to a second transfer station while advancing a second rotating mandrel into the first winding station for engagement with the advancing tape. The tape is severed between the first and second mandrels to define a trailing edge with the tape wound upon the first mandrel and the tape is then wound on the first mandrel in the second transfer station until the trailing edge is also wound thereon to form a completed coreless tape roll on the first mandrel.

To facilitate the coreless winding of the tape on a winding mandrel, in one embodiment the winding mandrel is rotated about a tape winding axis in a first direction and at a first rate. A cinch roller assembly rotates in a second, opposite direction. A support for the cinch roller assembly is movable relative to the winding mandrel between a first position spaced from the winding mandrel and a second position wherein the cinch roller assembly is urged into contact with the winding mandrel. When the support is in its second position, the cinch roller assembly is rotated at a second, faster rate, and a leading edge portion of an advancing strip of tape is wound about the winding mandrel. In the preferred embodiments, the leading edge portion of the strip of tape has a liner sufficient to at least mask the adhesive on an innermost wrap of tape being wound on the winding mandrel. In one preferred embodiment, the support also has a strand feed roller assembly, which rotates in the second direction, at the second faster rate, when the support is in its second position.

In one embodiment of the winding mandrel, it includes a cylindrical shaft having an axis of rotation, with at least a portion of the shaft having a circumferential tape supporting segment adapted for receiving tape wound thereon. The circumferential tape supporting segment has a tape engaging surface portion that, in a radial orientation, is compressible yet sufficiently stiff to support the tape as it is successively wound about the shaft to form a tape roll, and that is sufficiently pliant to permit ready axial removal of a wound tape roll from the shaft.

In another embodiment, the process for sequentially forming a plurality of coreless tape rolls of pressure sensitive adhesive tape includes longitudinally advancing a web having firsthand second major surfaces, with one surface thereof bearing pressure sensitive adhesive thereon. A liner/tab is applied across a lateral width of the advancing web on the adhesive bearing surface thereof. The advancing web is then wound about a mandrel member to define a tape roll, whereby an innermost wrap of the web for each tape roll includes an extent of the liner/tab sufficient to mask the adhesive thereon. Preferably, the inventive method also includes cutting the liner/tab and web laterally into two segments, with a first segment of the liner/tab defining said extent for one tape roll, and a second segment of the liner/tab defining a mask for adhesive along an outermost end portion of a web for a previously wound tape roll.

BRIEF DESCRIPTION OF THE DRAWINGS

The present invention will be further explained with reference to the drawing figures referenced below, wherein like structure is referred to by like numerals throughout the several views.

Figure 1:
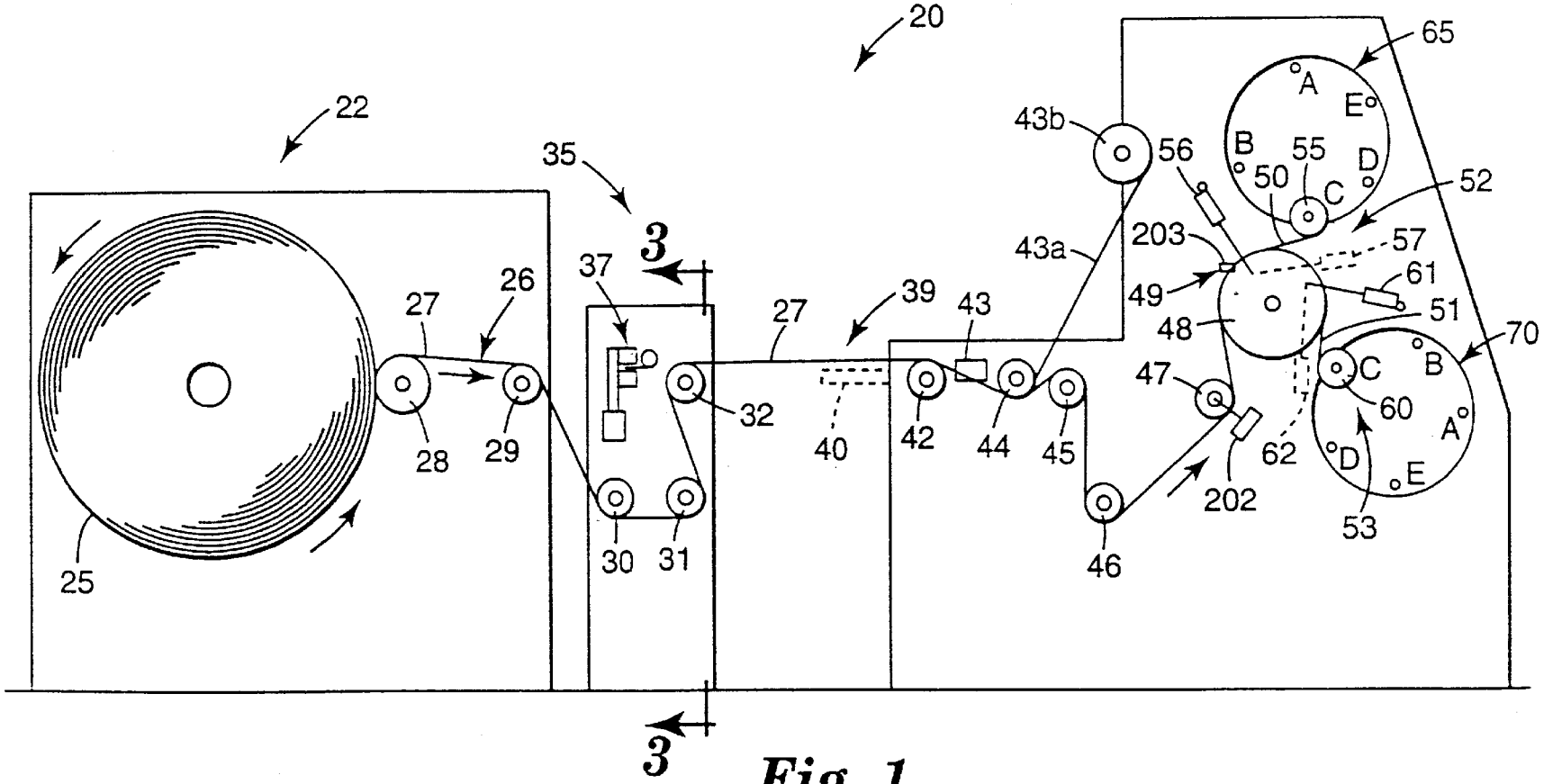
FIG. 1 is a schematic illustration of a tape roll winding apparatus of the present invention.

While the above-identified drawing features set forth a preferred embodiment, other embodiments of the present invention are also contemplated, as noted in the discussion. This disclosure presents illustrative embodiments of the present invention by way of representation and not limitation. Numerous other modifications and embodiments can be devised by those skilled in the art which fall within the scope and spirit of the principles of this invention. The drawing figures have not been drawn to scale as it has been necessary to enlarge certain portions for clarity.

DETAILED DESCRIPTION OF THE PREFERRED EMBODIMENTS

Introduction and Overview

Figure 2:
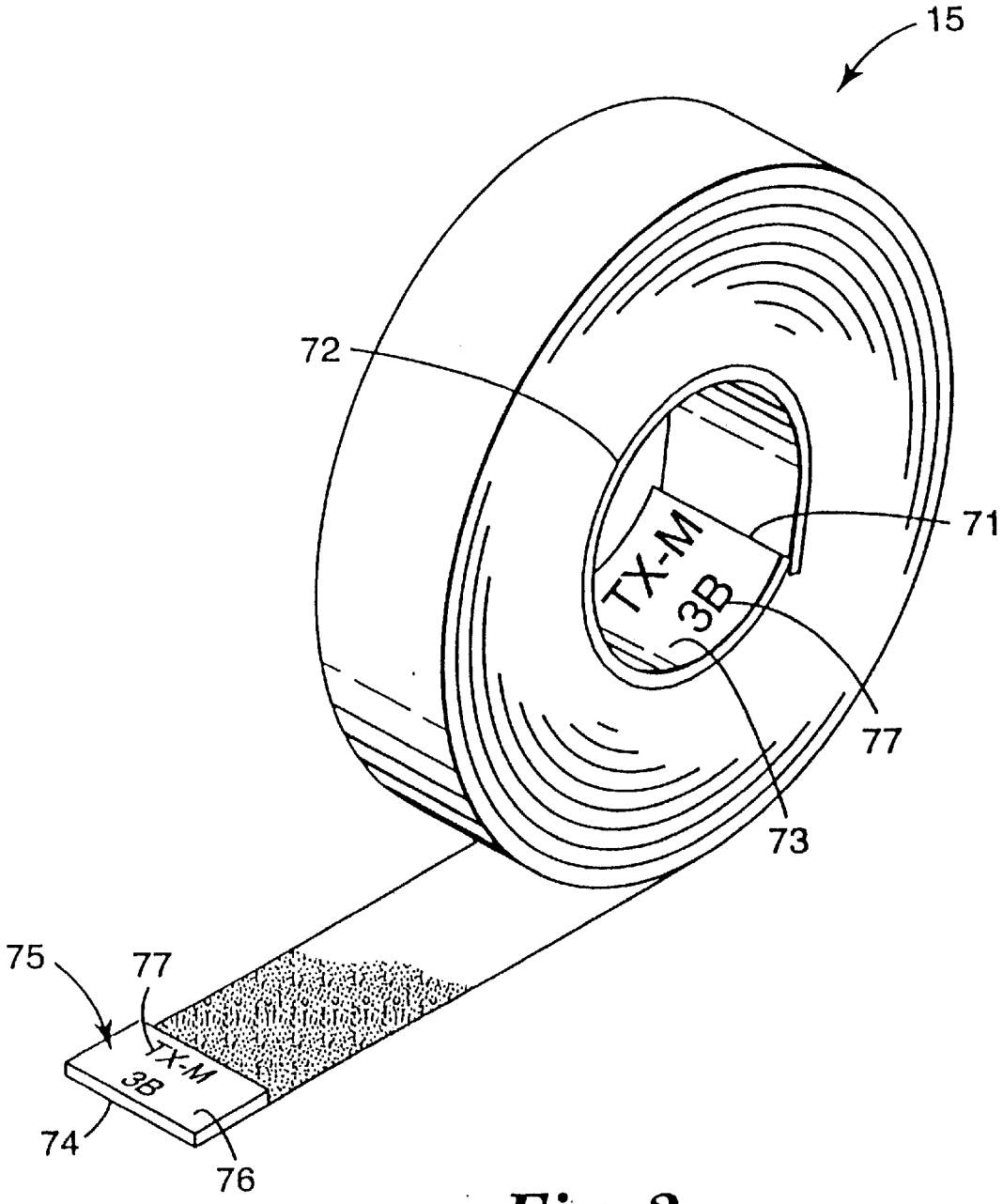
FIG. 2 is a perspective illustration of a completed tape roll formed by the tape roll winding apparatus and method of the present invention.

FIG. 1 illustrates an apparatus for performing the tape roll production method of the present invention. Essentially, the process involves starting with a relatively wide and long roll of a pressure sensitive adhesive web, and processing that roll into a plurality of narrower and shorter rolls of pressure sensitive adhesive tape. One such small roll of tape is illustrated in FIG. 2, as tape roll 15.

A tape roll winding apparatus 20 for forming coreless adhesive tape rolls is illustrated schematically in FIG. 1. The process begins at a web unwinding station 22, where a supply 25 of pressure sensitive adhesive sheet or web material 26 is aligned to feed web material 26 onto a travel path for the web material 26 through the tape roll winding apparatus 20. As shown, the supply 25 is in large roll form. For purposes of this disclosure, the terms "sheet" and "web" are deemed equivalent. The terms "length" and "longitudinal" are used in reference to the dimension of movement of the web material 26 along the travel path, while the terms "width" and "lateral" are used to refer to the dimension at right angles to the travel path of the web material 26. The direction of the web travel path is at right angles to the axes of the supply roll 25 and other process rollers shown in FIG. 1.

The web material 26 may be formed from any suitable materials such as paper, plastic, filament tape, nonwoven material or foil, and has first and second major surfaces. A pressure sensitive adhesive (tacky) layer 27 is borne on one of those major surfaces, while the other major surface has release properties (e.g., it is non-adhesive or nontacky). As is typical, the supply roll 25 is wound with the adhesive side of the web material facing inwardly toward the axis of the roll and the non-adhesive side of the web material facing outwardly.

For processing, the web material 26 is unwound from supply roll 25 over a peel-off roller 28 which is movable toward and away from the axis of the supply roll 25 in order to maintain contact with the periphery of the supply roll 25 as it unwinds. The non-adhesive surface of the web material 26 is thus drawn over the peel-off roller 28 (which is an idler roller) and then over idler positioning rollers 29, 30 and 31 to align the web material 26 for liner/tab application. As seen in FIG. 1, the adhesive surface of the web material 26 is drawn over and around idler rollers 30 and 31 (those rollers are release coated rollers). In an alternative embodiment, one or more of the "idler" rollers disclosed herein may be driven to aid in the unwinding and advance of the web material 26 through the tape roll winding apparatus 20.

The non-adhesive surface of the advancing web material 26 is then drawn over a back-up idler roller 32 in a liner/tab application station 35. In the liner/tab application station 35, a liner/tab applicator 37 is selectively activated to apply a liner/tab laterally across the advancing web material 26. The liner/tab serves to mask certain selected portions of the adhesive layer 27 on the web material 26. From the liner/tab. application station 35, the web material 26 advances to a splicing station 39, where a splice table 40 is pivotally mounted to provide a surface for manually splicing successive rolls of web material together. Alternatively, an on-line or "flying splice" mechanism may be provided to connect successive rolls of web material together.

As it continues along the travel path the non-adhesive surface of the web material 26 then passes over an idler positioning roller 42 and through an edge trim station 43. Each lateral side edge of the advancing web material 26 (and liner/tab thereon) is trimmed to define a precise width for the web material 26 for further processing. From the edge trim station 43, trimmed web material 43*a* along each side edge of the advancing web material 26 is directed over an idler roller 44 and then to a collection mechanism 43*b*. As is typical in tape winding apparatus, the collection mechanism 43*b* may constitute a level wind collector for the material trimmed from each side of the advancing web material 26.

The web material 26 is also advanced over idler roller 44, and then over idler rollers 45 and 46. The non-adhesive surface of the web material 26 engages idler roller 45, while the adhesive surface of the web material 26 engages idler rollers 44 and 46, both of which are release-coated idler rollers. The adhesive side of the web material 26 then engages main drive roller 47 (which is also a release-coated roller). The main drive roller 47 provides the primary traction or pulling force for advancing the web material 26 from the supply roll 25 through the tape roll winding apparatus 20.

From the main drive roller 47, the web material 26 continues on to a driven and grooved anvil roller 48 (with its non-adhesive side toward the roller 48), and a slitting station 49 thereon. The web material 26 is then slit by a plurality of laterally disposed and spaced knives acting in cooperation with the grooved anvil roller 48 to form a plurality of longitudinally extending tape strips 50 and 51 of web material (see FIG. 1). Extending laterally, alternate tape strips 50 and 51 are directed either to a first upper tape winding station 52 or to a second lower tape winding station 53, respectively.

At each winding station, the advancing tape strips are wound about a winding mandrel. Thus, a plurality of tape rolls are formed simultaneously on the same winding mandrel. In the upper winding station 52, initial winding of the innermost wrap of each tape strip 50 on a winding mandrel 55 is facilitated by a cut-off and winding assembly which has an upper enveloper assembly 56 and an upper lay-on roller and knife assembly 57. Likewise, initial winding the innermost wrap of each tape strip 51 about a winding mandrel 60 in the lower winding station 53 is facilitated by a cut-off and winding assembly which has a lower enveloper assembly 61 and a lower lay-on roller and knife assembly 62. The enveloper and knife assemblies at each winding station are mounted to selectively pivot toward and away from their respective winding mandrels. The winding mandrel 55 is mounted at its ends in a rotating upper turret assembly 65. The upper turret assembly 65 has opposed chucks for engaging each end of the winding mandrel 55 and rotatably driving the winding mandrel 55 when it has been advanced to the upper winding station 52. Five positions or stations are defined about the upper turret assembly 65, through which the winding mandrel. 55 cycles during tape roll production, including a winding mandrel loading position A, ready position B, winding position C (upper winding station 52), transfer position D and unloading position E. Likewise, a lower turret assembly 70 is provided with opposed chucks for engaging each end of the second winding mandrel 60 and rotatably driving the winding mandrel 60 when it has been advanced to lower winding station 53. The lower turret assembly 70 also has five positions or stations defined for movement of the winding mandrel 60 therethrough, including a winding mandrel loading position A, ready position B, winding position C (lower winding station 53), transfer position D and unloading position E.

After a plurality of tape strips have been simultaneously wound about their respective winding mandrel to a desired tape roll length, each tape strip is severed and the winding of tape rolls is completed on one winding mandrel while the winding of a new set of tape rolls begins about a new winding mandrel in each winding station. This severing is achieved while the enveloper and knife assemblies are advanced against a winding mandrel in its winding station. Each winding mandrel carrying completely wound tape rolls is then removed from its respective turret assembly, and the tape rolls thereon are removed from the winding mandrel.

As described below, this invention presents a unique apparatus and method for forming those tape rolls without the use of separate tape roll cores. The tape rolls are wound directly on the winding mandrels. To facilitate this, each circumferential segment of the winding mandrel that is aligned to accept an advancing tape strip has a tape engaging surface that, in a radial orientation, is compressible yet sufficiently stiff to support the tape as it is successively wound about the winding mandrel to form a tape roll. Each circumferential segment is also independently rotatable about the axis of the winding mandrel, with such rotation controlled by a clutch mechanism. In addition, the winding of coreless tape rolls is enhanced by utilization of a portion of the liner/tab which had been applied to the web material at the liner/tab application station. That liner/tab portion is aligned to form the innermost wrap of each tape roll, thereby masking the adhesive of the web material at its innermost wrap from the tape engaging surface on the circumferential segment of the winding mandrel. The tape engaging surface is sufficiently pliant to permit ready axial removal of the completed tape rolls off of the winding mandrel.

A coreless roll of pressure sensitive adhesive tape 15 as formed by the present inventive process is illustrated in FIG. 2. This tape roll 15 is formed from a single tape strip of web material 26 whose width was defined at the slitting station 49. The tape roll 15 has no separate core. Starting with its leading or inner edge 71, the innermost wrap 72 of tape strip is covered on its adhesive (inner) side by an extent of the liner/tab which had been applied to the web material 26 at the liner/tab application station 35, thus forming a liner 73 for the tape roll 15. At its trailing or outermost edge 74, a tape tab portion 75 of tape strip is defined that has its adhesive masked. The adhesive is masked by a segment 76 of a liner/tab that was applied to the web material 26 at tab application station 35. The remainder of that particular liner/tab formed the liner for a subsequently formed tape roll in the tape roll winding apparatus 20. Likewise, a segment of the liner/tab which defined the liner 73 of tape roll 15 formed the tab portion adjacent the trailing edge of a previously wound tape roll in the tape roll winding apparatus 20. Preferably, the liner/tab is provided with visually perceptible indicia 77 on one or both sides thereof, and the indicia 77 is visible upon formation of a completed tape roll 15 (both on tape tab portion 75 and innermost wrap 72).

Specific details regarding the coreless adhesive tape roll winding process and apparatus of the present invention are described below. It is contemplated that the invention will take alternative forms and formats, some of which are specifically noted. For example, the tape roll winding apparatus 20 illustrated in FIG. 1 advances the web material 26 with its adhesive surface facing generally upwardly. It is understood that in some applications it may be desirable to align the web material 26 so that for the most part, its surface bearing the adhesive faces generally downwardly. The disclosed orientation is not meant to be limiting, but merely illustrative. Numerous other modifications and embodiments of the inventive apparatus and process fall within the scope and spirit of the principles of this invention, and can be devised by those skilled in the art.

Liner/Tab Applicator

Figure 3:
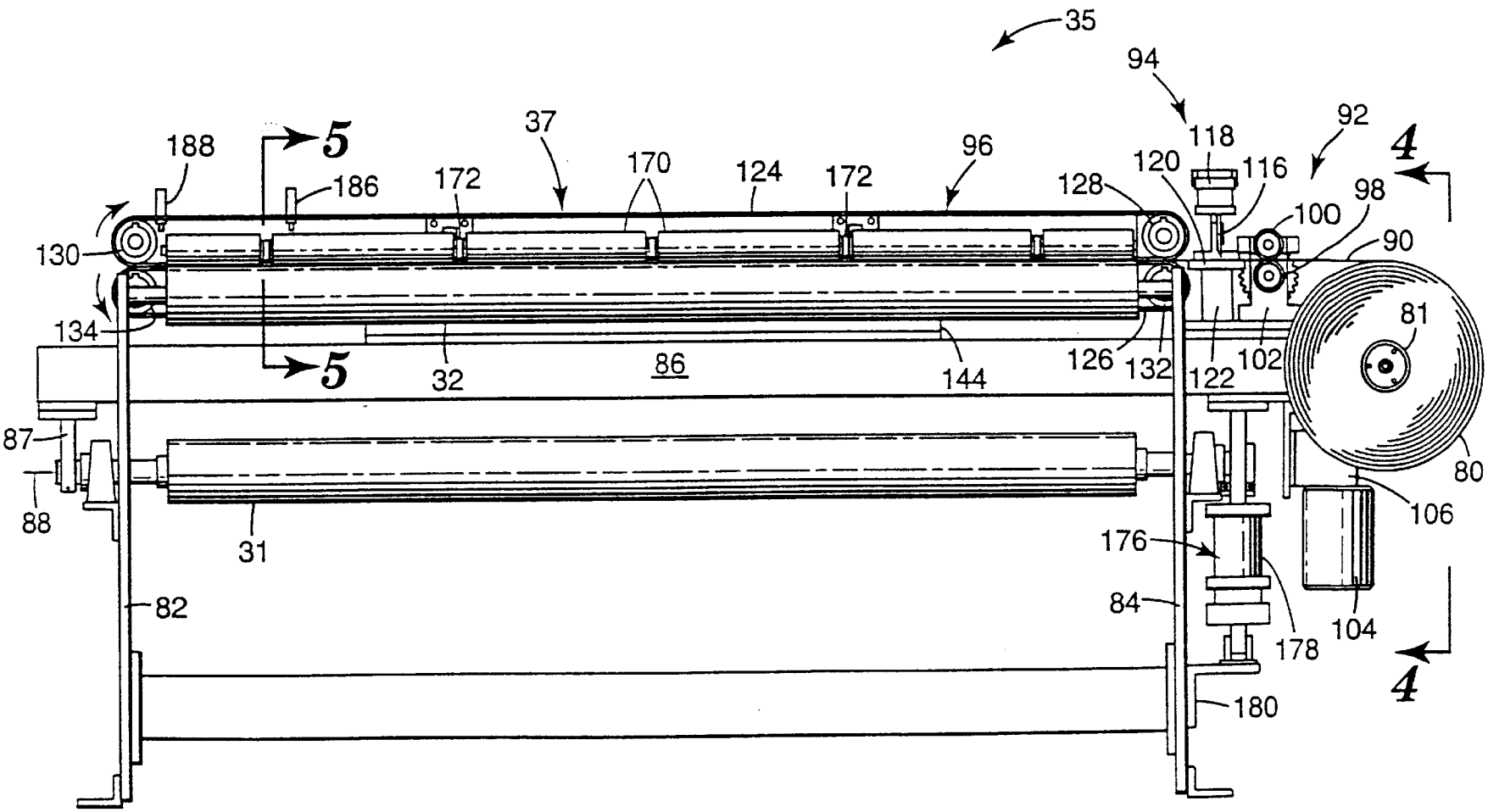
FIG. 3 is an elevational view as taken generally along lines 3—3 in FIG. 1.
Figure 4A:
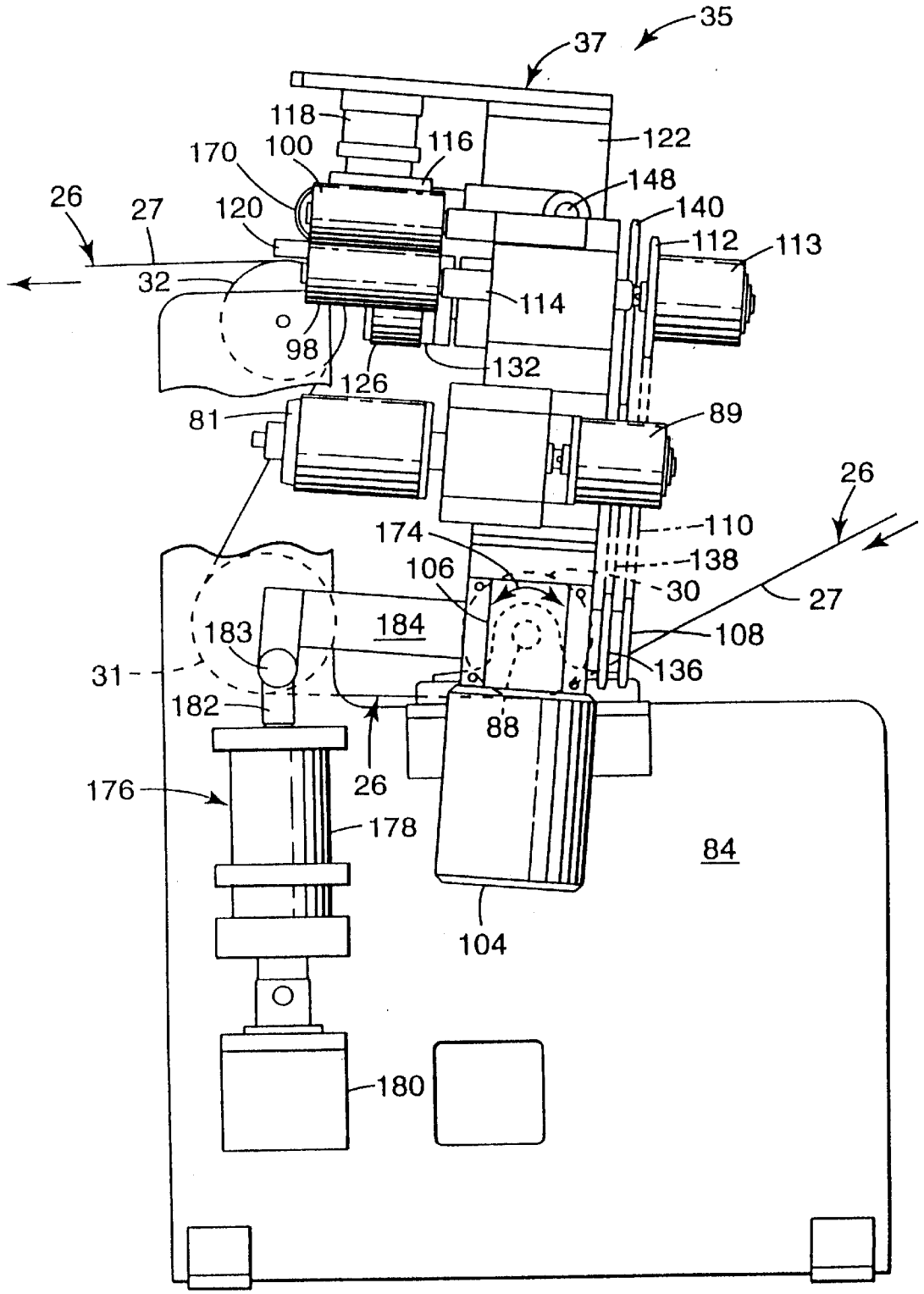
FIGS. 4*a* and 4*b* are side elevational views, as taken along line 4—4 in FIG. 3, with some parts removed and some parts broken away.
Figure 4B:
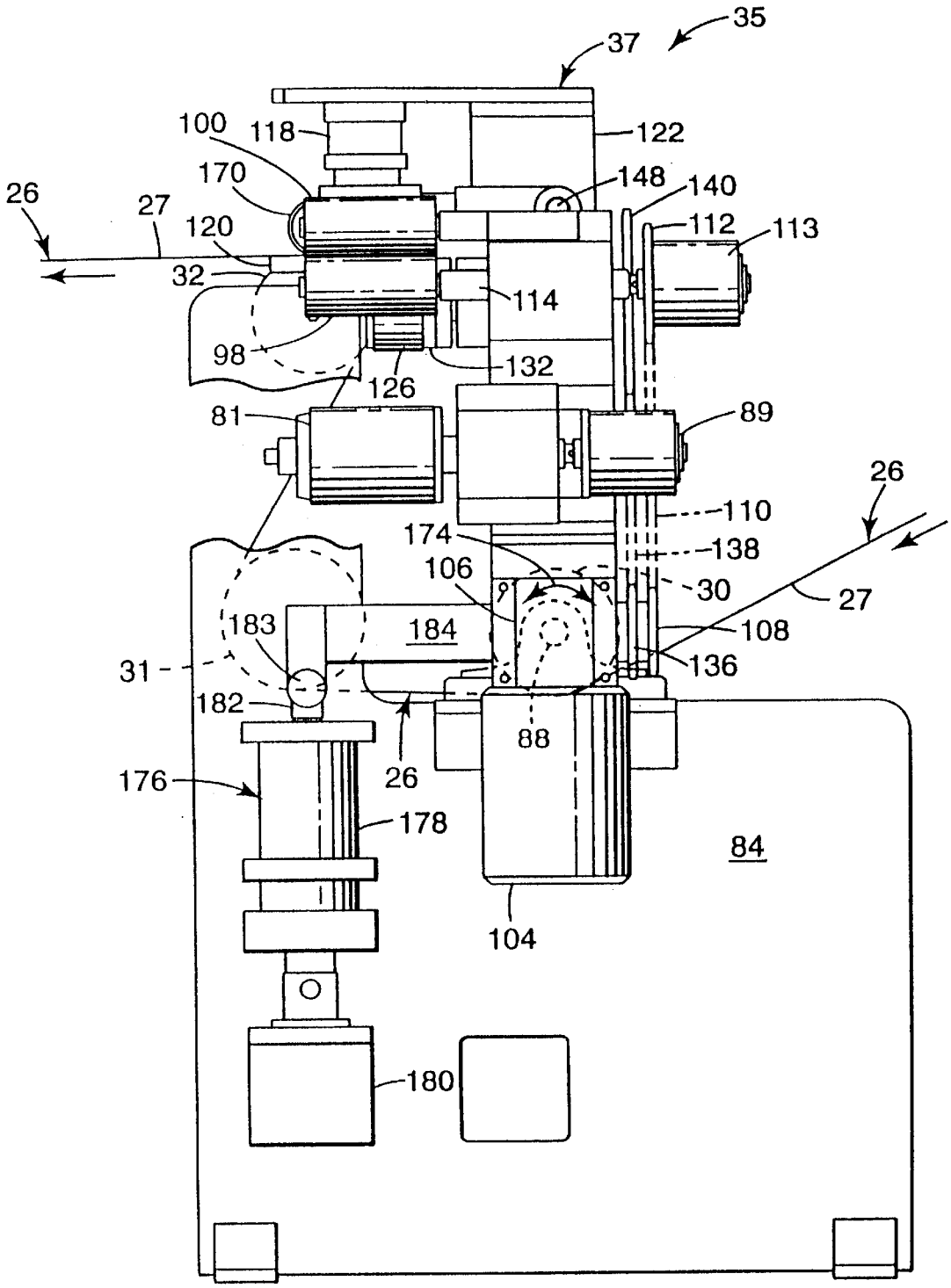

FIGS. 3–5 illustrate the liner/tab application station 35 in greater detail. As seen in FIG. 3, a supply roll 80 of liner/tab material is rotatably supported on a spindle 81 adjacent one side edge of the travel path of the web material. In FIGS. 4*a* and 4*b*, supply roll 80 has been removed from spindle 81 to permit illustration of other components of the liner/tab applicator 37.

In FIG. 3, idler rollers 31 and 32 are seen, as rotatably supported at their ends by frame panels 82 and 84 (the web material 26 is not shown in FIG. 3, for clarity). The spindle 81 is rotatably supported on a central frame bar 86 which extends laterally over the travel path of the web material. The central frame bar 86 has a pair of downwardly extending supports 87 adjacent its lateral end portions (see FIGS. 3 and 5*a*) which are rotatably mounted relative to the frame panels 82 and 84 along a common lateral pivot axis 88. Other operative components of the liner/tab applicator 37 are also supported by the central frame bar 86. As seen in FIGS. 4*a* and 4*b*, an air brake 89 is mounted on the spindle 81 to provide rotation resistance, and thereby prevent loose outer windings of liner/tab material 90 from forming as rotation of the supply roll 80 is suddenly started and stopped. In addition, side spool screens or panels (not shown) may also be provided to maintain the liner/tab material 90 in proper alignment on the supply roll 80.

The supply roll 80 supplies liner/tab material 90 to a feed assembly 92, a cutting assembly 94 and a belt feed assembly 96. The liner/tab material 90 is drawn from the supply roll 80 and fed laterally relative to the travel path of the web material 26 (facing its pressure sensitive adhesive side) by the feed assembly 92. The feed assembly 92 includes driven rubber-coated roller 98 and steel back-up idler roller 100, both of which are rotatably supported upon a roller support 102 mounted to the central frame bar 86. A drive motor 104 operates via a gearbox 106 (see FIGS. 3, 4*a* and 4*b*) to drive chain sprocket 108. Chain 110 engages driven sprocket 108 and, in turn, transmits power to chain sprocket 112, which is coupled via clutch 113 to a shaft 114 of driven roller 98. Activation of motor 104 thus causes drive roller 98 (when clutch 113 is engaged) to advance liner/tab material 90 through the nip between rollers 98 and 100, and to feed the liner/tab material 90 laterally across the cutting station 94 and into the belt feed assembly 96.

The cutting assembly 94 has a liner/tab knife 116, knife actuator 118 and cutting support table 120, all of which are supported from central frame bar 86 by knife support 122 (see FIG. 3). Normally, the liner/tab knife 116 is retracted or spaced above the knife support table 120 sufficiently to allow liner/tab material 90 to pass therebetween. Upon activation of the knife actuator 118, the liner/tab knife 116 is driven down through liner/tab material 90, which is supported for cutting by cutting support table 120. The cutting support table 120 has a groove aligned under the liner/tab knife 116 for permitting over travel of the cutting knife 116 and to ensure complete cutting of the liner/tab material 90. The cutting assembly 94 thus severs the liner/tab material 90 into discrete liner/tab segments 123 for application to the web material 26.

The belt feed assembly 96 includes two laterally extending endless belts 124 and 126 which are aligned to have a longitudinal lateral belt run wherein the belts 124 and 126 have contiguous and opposed outer faces. Upper belt 124 is supported at its ends by belt rollers 128 and 130. Lower belt 126 is supported at its ends by belt rollers 132 and 134. The inner surface of each endless belt is grooved lengthwise, and the circumferential surfaces of the belt rollers have mating grooves and ridges to ensure that the belts stay in proper alignment during operation. The belt feed assembly 96 is also driven by motor 104. Power is provided via the gearbox 106 to a chain sprocket 136, and then through chain 138 to chain sprocket 140. Chain sprocket 140 is, in turn, coupled to belt roller 132 to rotate roller 132 and drive belt 126 mounted thereon. Consequently, belt 124, which contacts belt 126 along their contiguous outer faces, is driven as well.

Belt rollers 132 and 134 for lower endless belt 126 are rotatably supported on lower plate structure 142 (FIGS. 5*a* and 5*b*), which is, in turn, mounted to bracket 144 secured to central frame bar 86. Belt rollers 128 and 130 for upper endless belt 124 are rotatably supported upon upper plate structure 146, which, in turn, is pivotally mounted as at lateral pivot axis 148 to a plurality of upstanding ear members 150, which, in turn, are secured to the bracket 144. Thus, the endless belts and their supporting structure are all supported by central frame bar 86, and when the central frame bar 86 is pivoted about its lateral pivot axis 88, the belt feed assembly 96 travels with it.

Figure 5A:
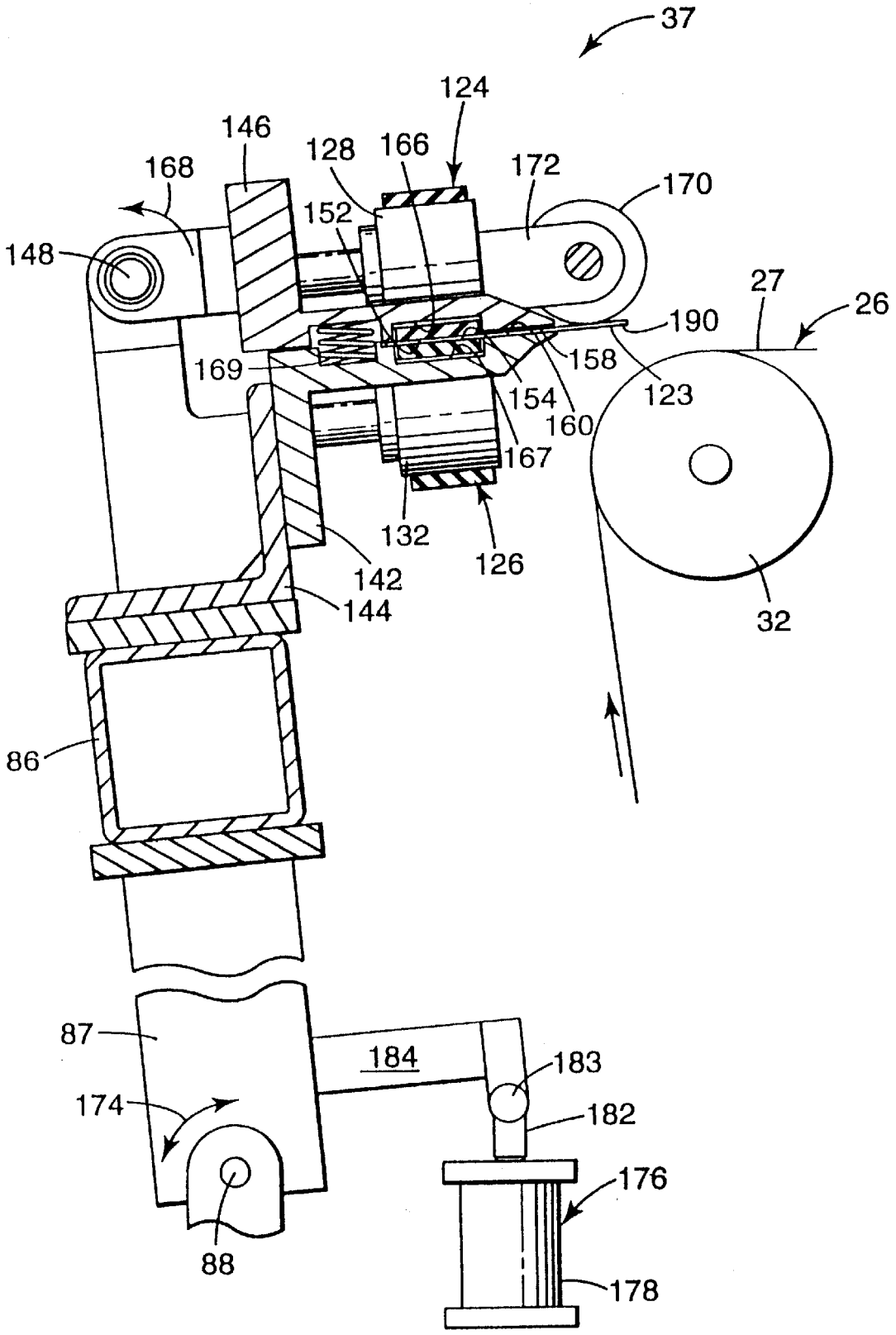
FIGS. 5*a* and 5*b* are sectional views as taken along line 5—5 in FIG. 3, with some components shown schematically for illustrative purposes.
Figure 5B:
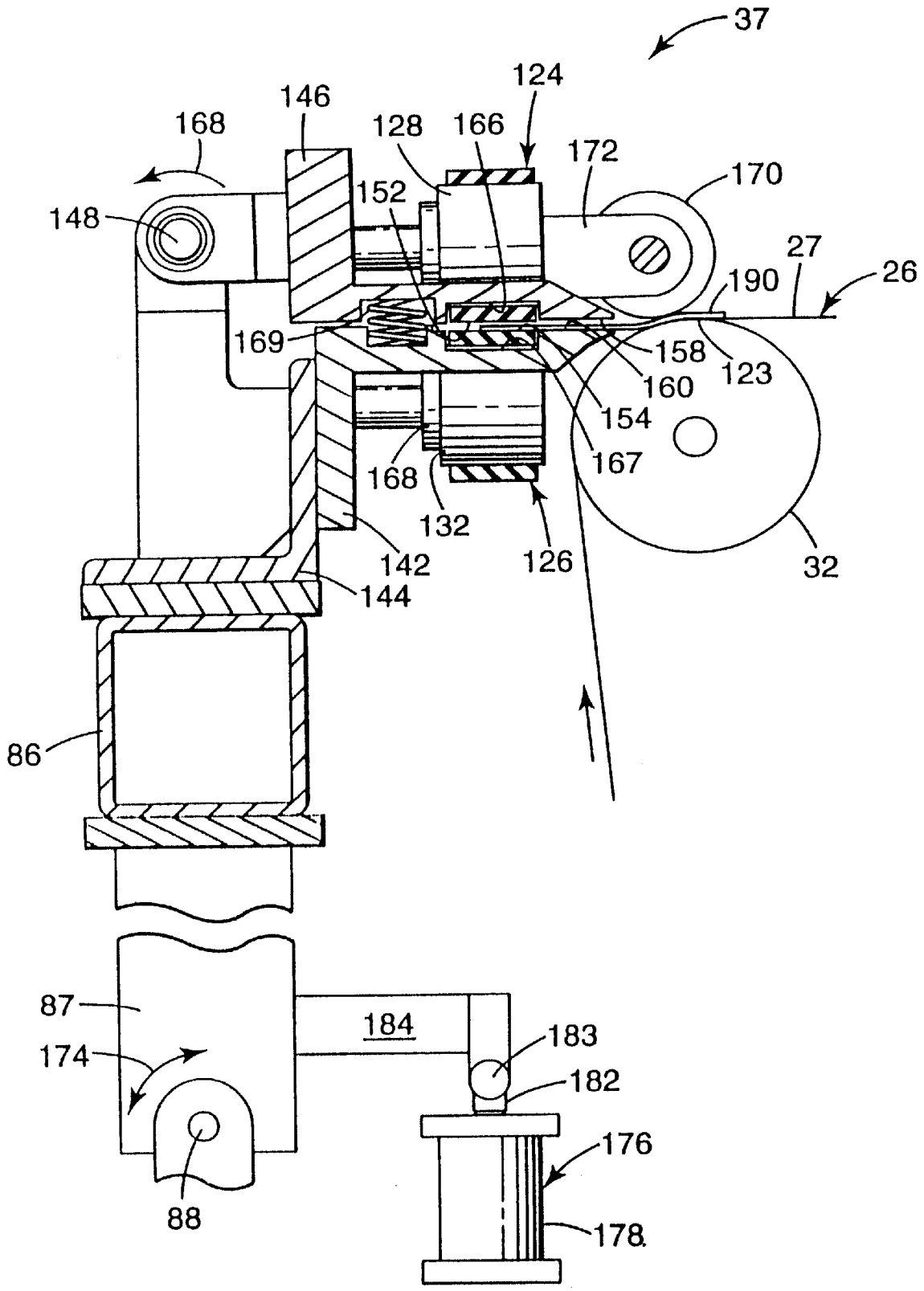

As seen in FIG. 5*a*, endless belts 124 and 126 are aligned with opposed facing outer surfaces 152 and 154. These surfaces are adapted to engage and entrain the liner/tab material 90 therebetween, as it is readied for application to the web material 26. The upper and lower plate structures 146 and 142 also have opposed facing surfaces 158 and 160 which are aligned to retain the liner/tab segment 123 therebetween. The opposing facing surfaces 158 and 160 of the upper and lower plate structures 146 and 142 are spaced apart sufficient to allow passage of the liner/tab material 90 therebetween. As seen in FIGS. 5*a* and 5*b*, the facing surfaces 158 and 160 of the upper and lower plate structures 146 and 142 are recessed to accommodate the endless belts 124 and 126, as at recesses 166 and 167. The upper and lower plate structures 146 and 142 extend laterally across the travel path of the advancing web material 26 to a width at least the extent of the width of idler back-up roller 32. The upper and lower plate structures 146 and 142 are designed to separate. The upper plate structure 146 can pivot (as indicated by arrow 168)) about pivot axis 148, and thereby permit separation of the opposed. facing outer surfaces 152 and 154 of endless belts 124 and 126. A plurality of laterally disposed spring elements 169 are positioned between the upper and lower plate structures 146 and 142 to counteract the weight of upper plate structure 146 during such separation.

Lay-on rollers 170 are rotatably supported on a plurality of ears 172 which are mounted to the upper plate structure 146. The lay-on rollers 170 are thus also pivotally mounted about pivot axis 148 relative to the central frame bar 86. The lay-on rollers 170 are axially aligned laterally across the travel path of the advancing web material 26, and arranged to define a roller nip with idler back-up roller 32 for deposition of the liner/tab segment 123 on the advancing web material 26 (see FIG. 5*b*).

As mentioned, the central frame bar 86 and all components mounted thereto are pivotally supported relative to the frame panels 82 and 84 about pivot axis 88. This pivoting action (referenced by arrow 174) is attained by means of a three-position, double-acting pneumatic cylinder 176 having its cylinder portion 178 mounted to the frame panel 84 by suitable means, such as mount bracket 180. An extensible piston rod 182 of the cylinder 176 is pivotally connected at its outer end (as at pivot axis 183) to an arm structure 184 which, in turn, is mounted to one of the supports 87 for the central frame bar 86. Linear extension of the piston rod 182 relative to the cylinder portion 178 thus causes the central frame bar 86 and components supported thereby to pivot about pivot axis 88 (clockwise as viewed in FIGS. 4*a* and 4*b*, or counterclockwise as viewed in FIGS. 5*a* and 5*b*). When the piston rod 182 is in its most extended position (not shown), the liner/tab applicator 37 is pivoted away from the web path to allow alignment of the web material on the web path.

In operation, the liner/tab application station 35 applies a liner/tab segment 123 during advancement of the web material 26 along its travel path. Each liner/tab segment 123 is aligned for lateral placement on the web material 26 as follows. Driven roller 98 and belt roller 132 are rotated by activation of the motor 104. The feed assembly 92 thus pulls liner/tab material 90 from the supply roll 80, past the cutting assembly 94 and into the belt feed assembly 96. A leading edge of the liner/tab segment 123 is engaged by the opposed outer surfaces 152 and 154 of the upper and lower endless belts 124 and 126 and liner/tab segment 123 is then carried laterally across the travel path of the web material 26. When the leading edge of the liner/tab segment 123 is detected by an optical sensor 186, the knife actuator 118 is signaled to drive the liner/tab knife 116 toward the cutting support table 120 and thus cut and define a trailing edge of the liner/tab segment 123, while also thereby defining a leading edge of the liner/tab material 90 that will form the next liner/tab segment. Simultaneously, the clutch 113 is disengaged to stop rotation of the driven roller 98 and hence stop the advance of the leading edge of the liner/tab material 90 at the cutting assembly 94. The belt feed assembly 96 continues to operate, and continues to laterally advance the liner/tab segment 123 until its leading edge is detected by a second optical sensor 188. Upon detection of the leading edge by sensor 188, the motor 104 is deactivated to stop the belt feed assembly 96. The endless belts 124 and 126 thus hold the liner/tab segment 123 in position for application to the pressure sensitive adhesive side of the advancing web material 26.

The formation and positioning of a liner/tab segment 123 occurs while the liner/tab applicator 37 is in a ready or run position, as illustrated in FIGS. 4*a* and 5*a*. In this position, the rod 182 of the cylinder 176 is extended to pivot the central frame bar 86 and the components thereon about pivot axis 88 sufficient to space the liner/tab segment 123 a short distance away from the advancing web material 26, as best seen in FIG. 5*a*. A leading lateral section 190 of the liner/tab segment 123 is, however, exposed below lay-on rollers 170 and aligned to engage the adhesive surface 27 of the advancing web material 26. This engagement occurs when the cylinder 176 is activated to retract its rod 182 and pivot the central frame bar 86 and components thereon to move the liner/tab applicator 37 to an applicator position, as shown in FIGS. 4*b* and 5*b*. In this position, the leading lateral section 190 of the liner/tab segment 123 engages the web material 26 and adheres thereto. The lay-on rollers 170 press and roll the liner/tab segment 123 against the web material 26 as it is pulled out of the liner/tab applicator 37. A slight interference is provided between idler back-up roller 32 and lay-on rollers 170, which is accommodated by the pivoting about pivot axis 148 of the upper plate structure 146 and away from the lower plate structure 142 (see FIG. 5*b*). As mentioned, this movement and support of the upper plate structure 146 is facilitated by the springs 169 between the upper and lower plate structures 146 and 142. This also separates the opposed outer surfaces 152 and 154 of the endless belts 124 and 126, thereby releasing the liner/tab segment 123 for its withdrawal from the liner/tab applicator 37.

After the second sensor 188 detects the absence of liner/tab material between the endless belts 124 and 126, the cylinder 176 is activated to extend rod 182 and return the central frame bar 86 and components thereon to the ready or run position illustrated in FIGS. 4*a* and 5*a*. The cylinder 176 is not activated to extend rod 182 solely in response to the detection of the absence of liner/tab material by the second sensor 188, however. The activation of cylinder 176 is also dependent upon completion of a predetermined time delay in the circuit for retraction of rod 182 which initiated the application of the liner/tab segment 123 on the advancing web material 26. After the time delay and "no liner tab material" signal from the second sensor 188, the motor 104 is also activated and clutch 113 engaged to initiate the steps necessary to position a next liner/tab segment in position for lateral application to the advancing web material 26.

The liner/tab applicator 37 of the present invention thus provides an efficient supply and delivery scheme for applying a mask onto an adhesive bearing side of a moving web. In this regard, the inventive liner/tab application scheme, although illustrated in connection with the formation of coreless pressure sensitive adhesive tape rolls, can also be used in connection with the formation of tape rolls having cores.

Web Slitting Station

During operation of the tape roll winding apparatus 20, the web material 26 with liner/tab segment 123 adhered thereto travels from the liner/tab application station 35 to the first lateral edge slitting station 43. At the first slitting station 43, a pair of knives disposed adjacent the lateral edges of the advancing web material 26 cut edge strips off of the web material 26 (and liner/tab segment 123 thereon) to define a precise width for the web material 26 for further processing. As mentioned, the material trimmed from the web material 26 is collected by a suitable collection mechanism 43*b*. As the web material 26 passes the main drive roller 47, its progress is tracked by a length encoder 202 coupled to the main drive roller 47. The length encoder 202 thus provides data as to the extent of web material 26 that has advanced along its travel path.

From the main drive roller 47, the web material is advanced to the anvil roller 48, which has a plurality of circumferential grooves extending side-by-side along the width thereof. The main drive roller 47 and anvil roller 48 are both driven by a common drive motor (not shown), as is conventional in tape slitting and winding machines of this type. The main drive roller 47 is driven to define line speed for the advancing web material, while the anvil roller 48 is driven slightly faster than drive roller 47.

Figure 6:
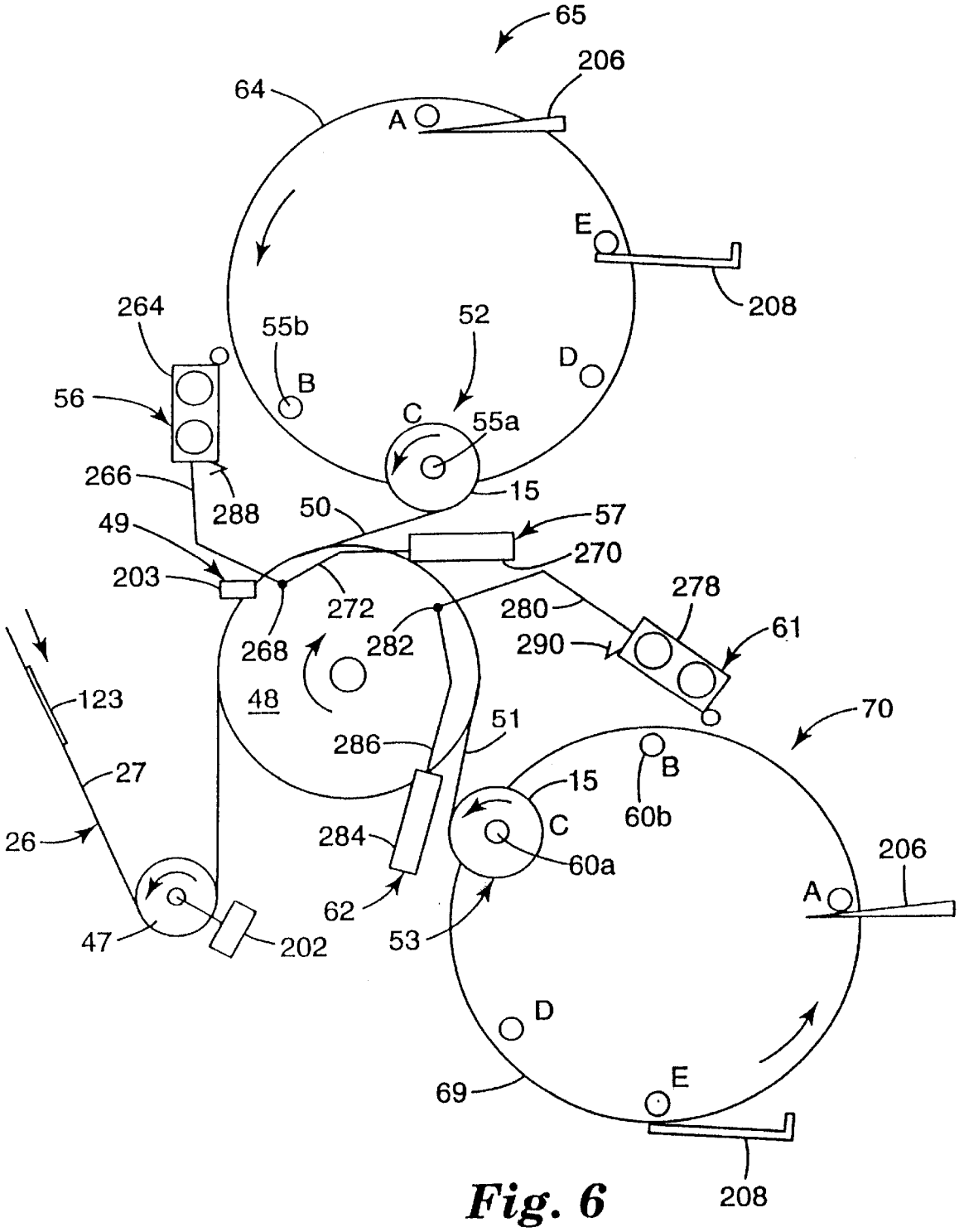
FIG. 6 is a schematic illustration of the tape winding section of the tape roll winding apparatus of the present invention showing the arrangement of components configured for tape winding.

While on the anvil roller 48, the web material 26 passes through the slitting station 49, which operates in cooperation with the grooved anvil roller 48. The slitting station 49 includes a plurality of knives 203 laterally disposed across the width of the material web 26 travel path. Each knife 203 extends in part into one of the circumferential grooves on the anvil roller 48. Thus, as the web material 26 advances through the slitting station 49, each knife 203 cuts the web material longitudinally into a plurality of tape strips 50 and 51 (FIG. 6). The lateral space between adjacent knives 203 defines the width of the tape strips cut thereby, and preferably, the knives 203 are equally spaced apart.

As the tape strips 50 and 51 are slit in the slitting station 49, the liner/tab segment 123 extending laterally across the web material 26 is also slit as it passes the knives 203. Thus, a liner/tab strip 204 is formed (as adhered to each tape strip 50), and a liner/tab strip 205 is formed (as adhered to each tape strip 51) (see FIG. 13). From the anvil roller 48, the tape strips 50 and 51 are then directed to the upper and lower turret assemblies 65 and 70. Alternate tape strips are directed to the alternative turret assemblies, as is typical in a tape slitter machine.

Coreless Tape Roll Winding

1. Turret Assemblies

From the anvil roller 48, the tape strips 50 are directed to the first winding station 52 in the upper turret assembly 65. A winding mandrel 55*a* is rotatably driven in the first winding station 52, and the tape strips 50 are wound thereon, as seen in FIG. 6. Likewise, the tape strips 51 are directed from the anvil roller 48 to be wound upon a winding mandrel 60*a* rotatably driven in the second winding station 53 of lower turret assembly 70. Thus, the tape strips 50 and 51 are simultaneously wound on separately rotating winding mandrels in their respective turret assemblies to form tape rolls 15 thereon.

The turret assemblies are preferably articulated turret assemblies, which are of the type which is conventional in the pressure-sensitive adhesive tape manufacturing industry. A suitable articulated turret assembly is the KampfRSA-450 turret of Jagenburg GmbH, Germany. In the articulated turret assemblies disclosed herein, each turret assembly consists of a pair of spaced turret heads 64 and 69 (only one of which is shown in the drawings for each turret assembly) between which the winding mandrels 55 and 60 are supported and mounted for rotation, respectively. Conventionally, the turret assemblies contain drives (not shown) for indexing the turret heads, i.e., rotating them to transport the winding mandrels among different positions about each turret assembly. Each turret assembly has two or more pairs of winding mandrel chucks, and each pair of chucks can independently engage and independently rotatably drive a winding mandrel. It is also contemplated that a fixed turret assembly can be used for the present invention, such as the RS240 turret of Ghezzi & Annoni SpA, Italy.

A winding mandrel is positioned for use on its turret assembly by means of loading ramp 206. In articulated turret assemblies such as those illustrated and contemplated for use in connection with the present invention, each separate pair of winding mandrel chucks on a turret assembly has a separate drive motor to independently index those chucks about their positions on the turret assembly. A pair of empty chucks engage the ends of the winding mandrel at position A (off of the loading ramp 206). Those chucks are then advanced to position B, placing the winding mandrel in a ready position for tape winding. The chucks are then further advanced to position C for engagement and winding of tape strips thereon. Once winding is nearly completed, that pair of chucks is then indexed to position D to finish the winding process for the winding mandrel therebetween. Finally, the chucks are advanced to position E, where the chucks release the winding mandrel, thereby allowing it to exit its turret assembly via unloading ramp 208. While the relative positions of the winding mandrel stations about the turret assemblies 65 and 70 differ, their functional aspects are the same, moving through winding mandrel loading position A, winding mandrel ready position B, winding mandrel winding position C (the winding stations), winding mandrel transfer position D and winding mandrel unloading position E. All of the winding mandrels in their respective chucks may be driven by one drive motor through a plurality of clutch means, or by separate independently controlled drive motors, one for each pair of winding mandrel chucks (these drive motors are not shown).

2. Winding Mandrel

Figure 7:
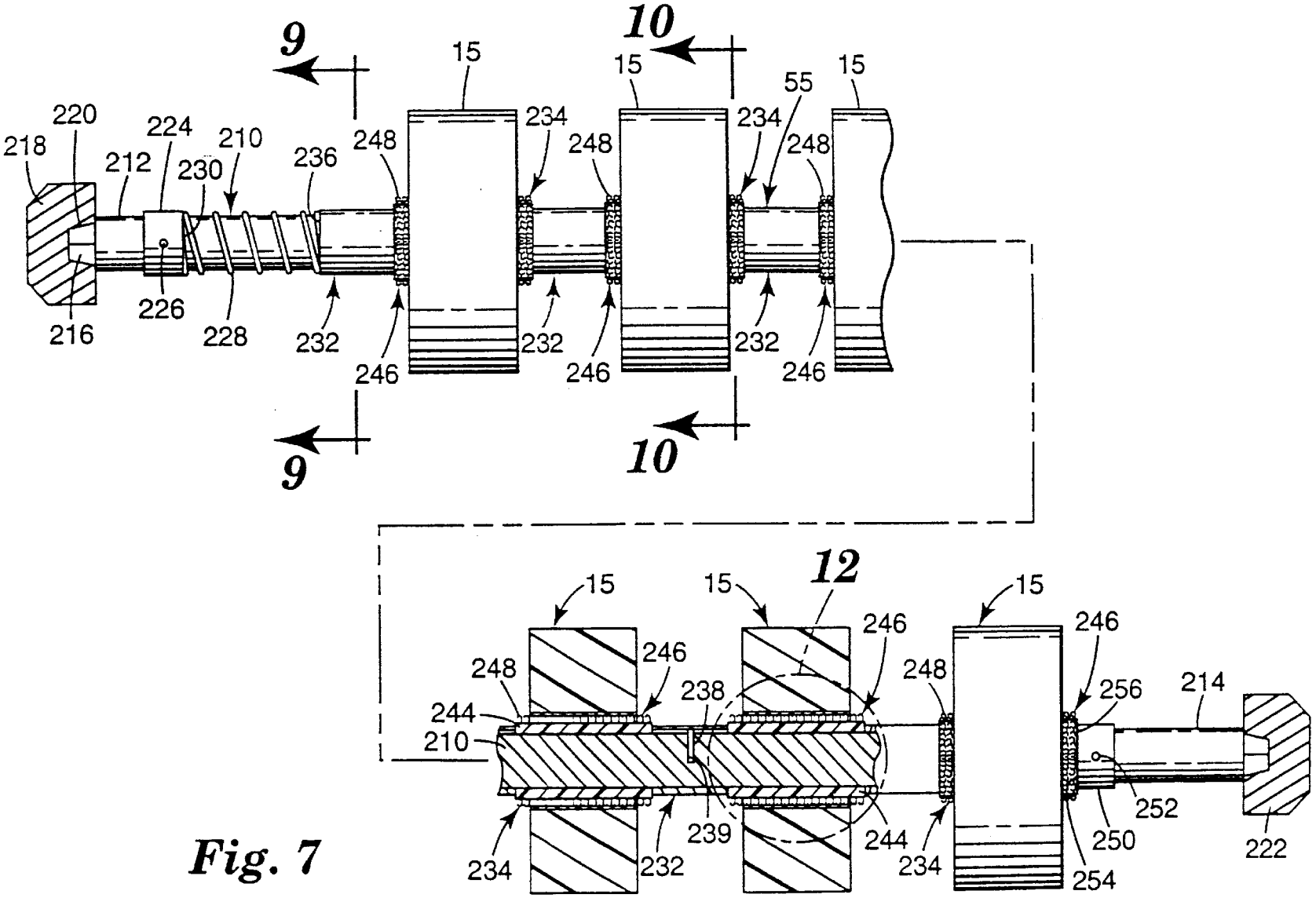
FIG. 7 is an elevational view of a winding mandrel of the present invention, broken away laterally and with portions thereof shown in section.
Figure 8:
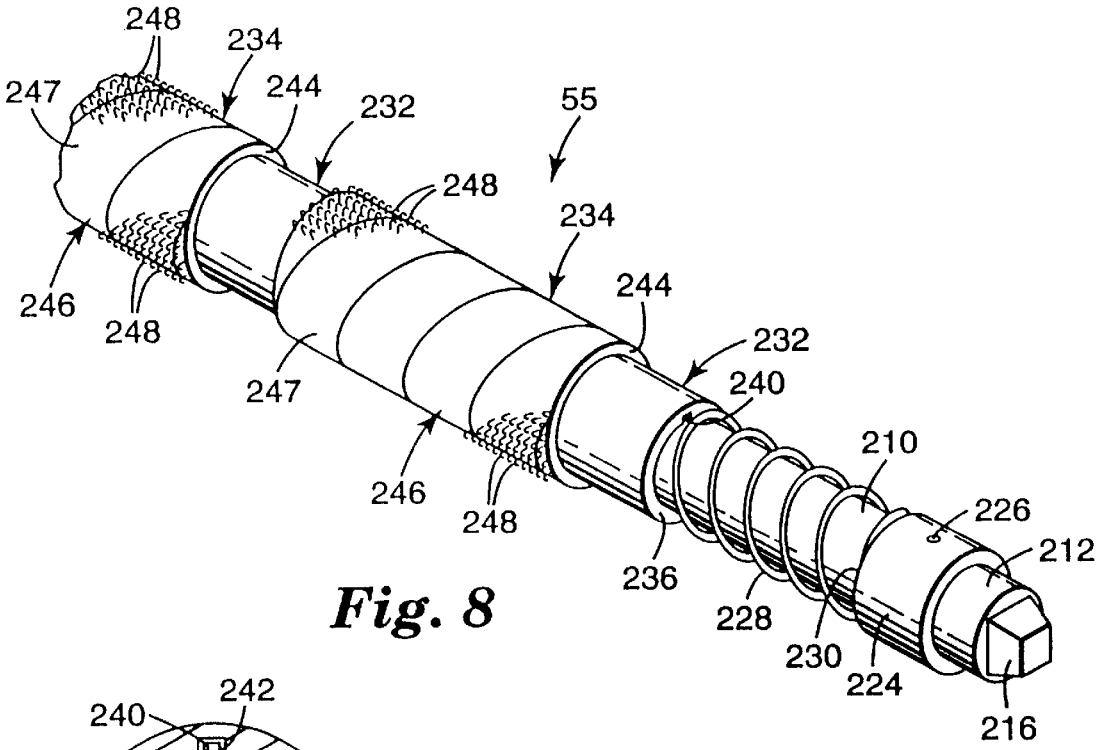
FIG. 8 is a perspective view of one end of the winding mandrel of FIG. 7.

The unique structure of a caliper compensation winding mandrel of the present invention is illustrated in FIGS. 7–12. For example, a winding mandrel 55 has a central cylindrical shaft 210 with ends 212 and 214. At least one end (such as end 212) has a chuck engaging end portion 216, which is formed to mate with a chuck 218 having a similarly shaped recess or mating portion 220 thereon. The end portion 216 may be squared off (as illustrated in FIG. 8), or it may have other rotational mating structures such as keyed portions or a tapered cone that operates in conjunction with a mating shape on the chuck. Adjacent the other end 214 of the cylindrical shaft 210, a chuck 222 also engages the shaft 210. The chucks 218 and 222 are selectively movable axially away from the shaft 210 to permit its loading and unloading on the upper turret assembly 65. When engaged, as seen in FIG. 7, however, the chucks 218 and 222 affirmatively engage the cylindrical shaft 210 for coupled rotation therewith.

Figure 9:
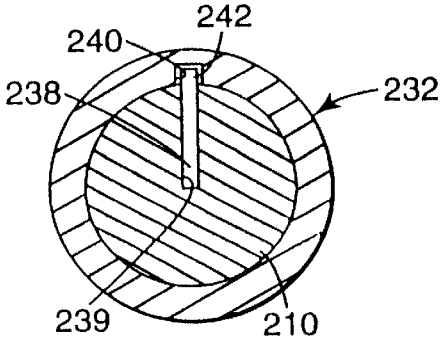
FIG. 9 is a sectional view as taken along line 9—9 in FIG. 7.
Figure 10:
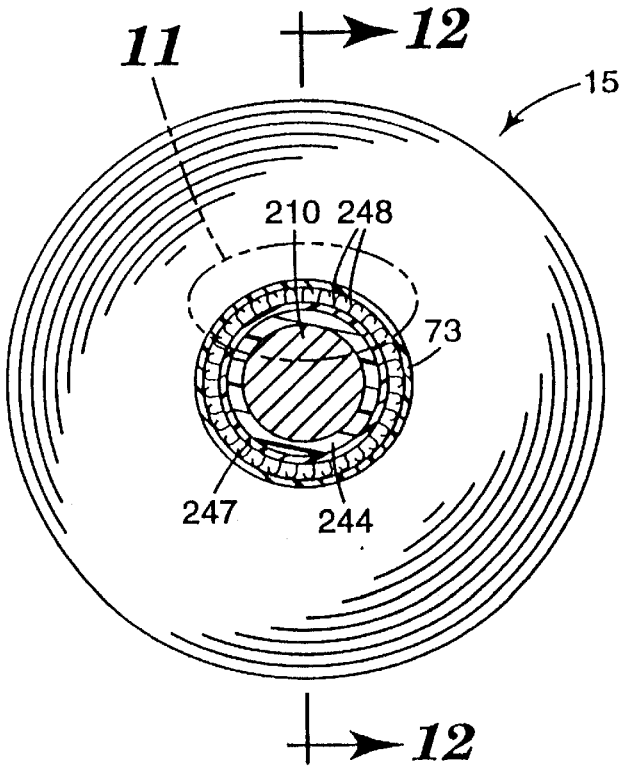
FIG. 10 is a sectional view as taken along line 10—10 in FIG. 7.

An end stop sleeve 224 is secured to the cylindrical shaft 210 adjacent one end thereof. In one embodiment, the end stop sleeve 224 is fixedly secured to the cylindrical shaft 210 by means of pin 226, thereby limiting it from axial or rotational movement relative to the shaft 210. Alternatively, the position of the end stop sleeve 224 is variable along the cylindrical shaft 210. A compression spring 228 is mounted about the shaft 210 adjacent the end stop sleeve 224 and abuts an annular face end 230 of end stop sleeve 224, as seen in FIGS. 7 and 8. A plurality of alternating spacer tubes 232 and core tubes 234 are aligned along the length of the cylindrical shaft 210. One of the spacer tubes 232 is positioned adjacent the compression spring 228, with an annular face end 236 thereof abutting the compression spring 228. Each spacer tube 232 has an inner diameter slightly larger than the outer diameter of the cylindrical shaft 210. As best seen in FIG. 9, each spacer tube 232 is aligned over a pin 238 extending through abore 239 in the cylindrical shaft 210. Each spacer tube 232 has an axial groove 240 along its inner surface which receives a head 242 of the pin 238 therein. Thus, the spacer tubes 232 can move axially relative to the shaft 210, but the pin 238 prevents rotational movement of the spacer tube 232 with respect to the shaft 210.

A core tube 234 is aligned on the shaft 210 between each pair of adjacent spacer tubes 232, as seen in FIGS. 7 and 8, and is adapted for reusable use in forming coreless tape rolls thereon. Each core tube 234 is formed from a cylindrical sleeve 244 (see FIGS. 7, 10 and 11). Preferably, the sleeve 244 is formed from a low-friction, durable material such as DELRIN® material, available from E. I. du Pont de Nemours and Company, Inc., of Wilmington, Del. The inner diameter of the sleeve 244 is slightly larger than the outer diameter of cylindrical shaft 210. The sleeve 244 is thus free to move axially and rotatably relative to the shaft 210, constrained only by means of the spacer tubes 232.

Figure 12:
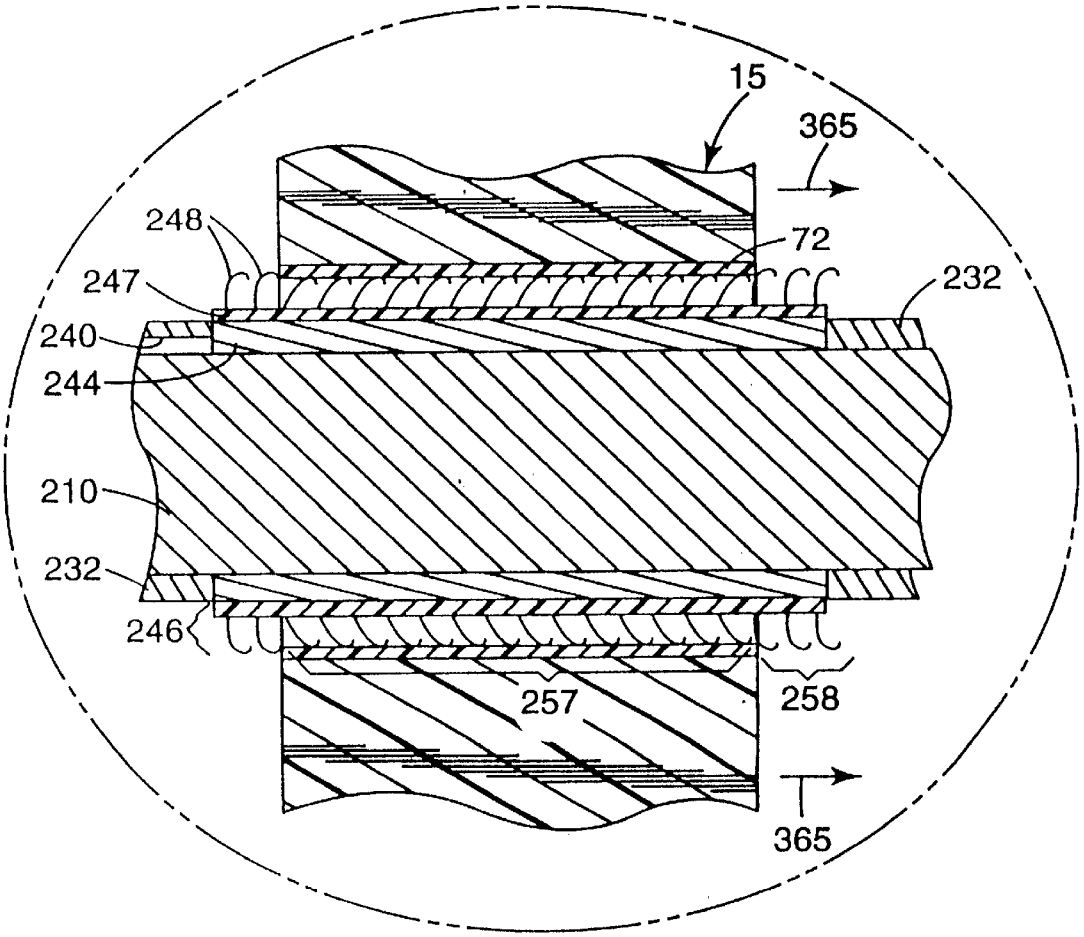
FIG. 12 is an enlarged view of the encircled portion in FIG. 7, illustrating axial removal of wound tape rolls from the winding mandrel.

A radially compressible material layer 246 is mounted about the circumference of each sleeve 244. Preferably, the material layer 246 is formed from SCOTCHMATE® hook material having a pressure sensitive adhesive backing, manufactured by Minnesota Mining and Manufacturing Company of St. Paul, Minn., and identified by Part No. 70-0704-2795-3. As illustrated in FIG. 8, such material is preferably spirally wound about and affixed to the exterior circumferential surface of sleeve 244 by its adhesive backing. This SCOTCHMATE® material is defined by a base layer or fabric 247 which supports a plurality of upstanding stems 248. Each stem is formed as a small polymer filament which extends generally outwardly from the winding mandrel shaft 210 and has a hook portion at an outermost end thereof. While the radial orientation of the stems 248 is not as uniform as illustrated in FIGS. 7, 8 and 12, the outermost ends of the stems 248 of the compressible material layer 246 are generally equal in height, and serve to define a low surface area outer circumference of the core tubes 234. It is about this outer circumference that the tape strips are applied and wound, and when the innermost wrap of each tape strip is tightened. thereon, the compressible material layer 246 provides enough friction so there is very little or no slippage between the tape strips and the stems 248 during winding. The tape strips are applied directly onto the compressible material layer 246. When tape rolls are formed by the inventive method, as further discussed below, it is preferably not the adhesive on the tape strips 50 (or 51) which engages the compressible material layer 246, but rather their respective liner/tab strips 204 (or 205) which engage the compressible material layer 246 and define an innermost wrap 72 of a tape roll 15 wound thereabout. As such, the innermost wrap 72 forms the liner 73 for the tape roll 15 (see FIG. 2).

As mentioned, the spacer tubes 232 and core tubes 234 alternate in the above-described manner along the central cylindrical shaft 210. At the other end 214 of the winding mandrel shaft 210, a second end stop sleeve 250 is secured over the shaft 210 and is secured thereto by pin 252. As seen in FIG. 7, an inner annular end face 254 of stop sleeve 250 abuts an annular end face 256 of an adjacent core tube 234. The end stops 224 and 250 are positioned on the winding mandrel shaft 210 to place the compression spring 228 in compression, thereby placing an axial compression force against the spacer and core tubes 232 and 234. Thus, the core tubes 234, while free to rotate about the shaft 210, are retarded from completely free rotation by this arrangement. The amount of rotation inhibition is a function of a number of variables, including force exerted by compression spring 228, and serves to define a constant torque during tape winding.

As seen in FIG. 7, each core tube 234 is wide enough to accept a tape strip for forming tape roll 15. The spacing between core tubes 234 is determined by the width of the spacer tubes 232. However, because alternative tape strips are fed to the winding mandrel 55 from the anvil roller 48, the spacing between the edges of adjacent tape strips coming to winding mandrel 55 is preferably the same as the width of each tape strip (when the knives 203 are equally spaced apart).

The winding mandrel illustrated in FIGS. 7–12 is a winding mandrel 55 for use in the upper turret assembly 65. As mentioned, the tape strips 51 being wound on the winding mandrel 60 in lower turret assembly 70 alternate (in lateral relation) with the tape strips 50 being wound at the same time on the winding mandrel 55 in upper turret assembly 65. With this in mind, it is understood that the winding mandrels used in the upper turret assembly 65 are functionally the same as the winding mandrels used in the lower turret assembly 70, except that the intervals of the spacer tubes and the core tubes is reversed along the lateral widths of the respective winding mandrels.

It is possible to manufacture tape rolls of different widths using the same winding mandrel (even at the same time). Such widths would be multiples of the smallest possible width (one tape roll per core tube). Thus, a tape roll could be formed on the winding mandrel that spanned two core tubes and a spacer tube therebetween (or three core tubes and the two spacer tubes therebetween, etc.) by revising the lateral spacing of knives 203 in the slitting station 49. Alternatively, different winding mandrels having different widths (i.e., spacing) of their aligned spacer tubes and core tubes can be used with correspondingly different knife spacings in the slitting station 49.

Each winding mandrel thus serves as an axial base for tape winding. As a tape strip is advanced about the winding mandrel, it engages the compressible material layer 246. Specifically, when the tape is wound with its adhesive side facing the winding mandrel winding axis, the liner 73 (see FIGS. 2 and 11) engages the outermost ends of the stems 248, since the liner 73 defines the innermost wrap 72 of each tape roll 15. Collectively, the stems 248 are stiff enough not to flatten as the innermost wrap 72 is placed thereon, but resilient enough to slightly bend and provide an overall diameter reduction (radial compression) as the innermost wrap 72 is tightened (i.e., cinched) about the core tube 234 and then held in place by the adhesion of the further wraps of the tape strip thereabout. The stems 248 bend and allow a generally uniform compression about the core tube 234, thereby defining the inner diameter for each tape roll 15. The bending and compression of the stems 248 is illustrated in FIG. 12. A segment 257 of stems 248 under the innermost wrap 72 of a tape roll 15 is shown bent in compression about shaft 210. A section 258 of stems 248 on the same core tube 234 is shown uncompressed, where there is no tape wound thereabout.

It is contemplated that other materials will also be suitable to define the compressible and resilient material on the winding mandrel. Such materials may include, for example, a bristle structure such as BRUSHLON® material of Minnesota Mining and Manufacturing Company of St. Paul, Minn., or a loopy material having the desired resilience and compressibility characteristics. Other materials suitable for this purpose would include steel leaf springs, a plurality of spring-loaded devices such as VLIER® pins (manufactured by Vlier Engineering, Burbank, Calif.), steel VELCRO® material (manufactured by Velcro USA, Inc., Manchester, N.H.), a lubricous foam material, or some engineered composite of the above-mentioned materials, which is a non-exclusive list. Any such material is suitable, so long as it provides the desired radial compressibility, yet is stiff enough to maintain the tape material wound thereabout for defining its inner diameter and is low friction enough to permit ready axial removal of a completed tape roll from the winding mandrel. The material is also sufficiently resilient to resume its original form after being compressed during the tape winding process.

Preferably, the tensioner clutch mechanism for controlling the rate of rotation of core tubes (i.e., torque on the tape being wound) across a winding mandrel can be controlled by varying the compression of spring 228. To do so, the end stop collar 224 can be selectively fixed at adjustable positions along the shaft 210 (such as by cooperative threading between the collar 224 and shaft 210) or spacer shims can be added between the end stop collar 224 and spring 228 to vary the compression placed on the spring 228. Alternatively, instead of the spring 228, axial clutch pressure may be exerted upon the spacer tubes 232 by a yoke (supported adjacent the turret assembly) which through operation of a suitable activator, is moved to engage a radially disposed face (such as face 236) of the outermost spacer tube on a winding mandrel and applies axial pressure thereto as the winding mandrel is rotated.

Another alternative winding mandrel tension construction has compressible springs adjacent each end of the winding mandrel (within fixed end stops on the winding mandrel shaft). A third fixed stop is secured to the shaft adjacent its midpoint, and thus allows the separate definition of axial compression (and torque) for each half of the winding mandrel by the two separately compressed springs.

It is also contemplated that a mechanically operable winding mandrel may also function in the process and apparatus of the present invention. For example, a diametrically collapsible/expandable winding mandrel or button bar will suffice, so long as it provides caliper compensation (independent rotation capability for each tape roll being wound) and means for support of the tape while wound and for permitting ready removal of a completed tape roll from the winding mandrel.

3. Cut-Off and Winding Assemblies

Figure 13:
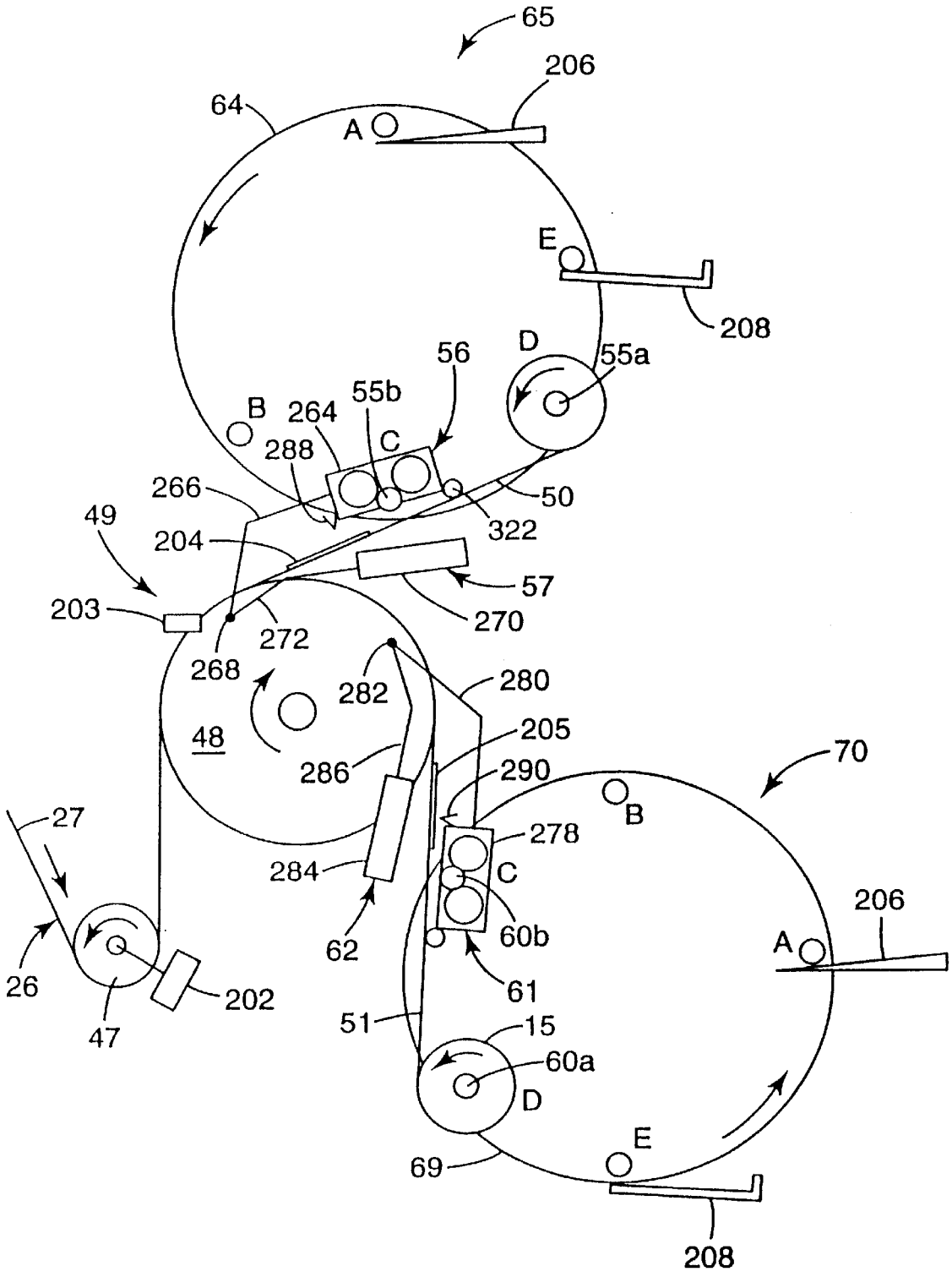
FIG. 13 is a schematic illustration of the tape winding section of the tape roll winding apparatus of the present invention showing the arrangements of components just prior to severing of the advancing tape strips to initiate the formation of coreless tape rolls.

The initiation of coreless winding on a winding mandrel and the severing of tapes between successive winding mandrels in each turret assembly is facilitated by a tape cut-off and winding assembly that includes a pair of cooperative assemblies which pivot into engagement with the winding mandrel in its winding station. Thus, it is imperative that the turret assembly provide relatively precise positioning of the winding mandrel in the winding station so that it is properly aligned for interaction with the tape cut-off and winding assembly. As seen in FIGS. 6 and 13, for the winding station 52 of the upper turret assembly 65, the cut-off and winding assembly is defined by the upper enveloper assembly 56 and the upper lay-on roller and knife assembly 57. The upper enveloper assembly 56 includes an enveloper frame 264 supported by an arm 266 which is pivotally mounted along a lateral pivot axis 268. The upper knife assembly 57 has a knife frame 270 supported by an arm 272, which is also aligned for pivoting along lateral pivotal axis 268. Likewise, the winding station 53 of the lower turret assembly 70 has a cut-off and winding assembly defined by the lower enveloper assembly 61 and a lower lay-on roller and knife assembly 62. The lower enveloper assembly 61 has an enveloper frame 278 supported by an arm 280 which is pivotally mounted along a lateral pivot axis 282. The lower knife assembly 62 has a knife frame 284 supported by an arm 286 which is also pivotally mounted along lateral pivot axis 282.

Referring again to the turret assemblies (FIGS. 6 and 13), the wrapping of tape strips about a winding mandrel begins in its respective winding station, and the bulk of the winding also takes place in that winding station. When the winding of tape strips 50 upon winding mandrel 55*a* is nearly complete in the winding mandrel winding station 52 (position C), an empty winding mandrel 55*b* is advanced by the upper turret assembly 65 into ready position B (see FIG. 6). Likewise, the winding mandrel 60*a* is simultaneously winding tape strips 51 in its winding station 53 (position C) of the lower turret assembly 70. When the winding on winding mandrel 60*a* is nearly complete, an empty winding mandrel 60*b* is advanced to its ready position B.

The enveloper and knife assemblies extend laterally to engage the winding mandrel and tape strips wound thereon in each winding station. During winding (as illustrated in FIG. 6), the enveloper and knife assemblies are pivoted away from their respective winding mandrels to permit the indexing of empty winding mandrels about the turret assemblies specifically (from position A to position B). However, when winding is nearly complete upon a winding mandrel (such as for winding mandrels 55*a* and 60*a* in FIG. 6), the turret assembly chucks in position C are indexed and winding mandrels 55*a* and 60*a* are moved to position D on their respective turret assemblies (as seen in FIG. 13). While the winding mandrels 55*a* and 60*a* in position D continue to rotate and wind tape strips thereon, empty winding mandrels 55*b* and 60*b* are moved from position B on each turret assembly into the winding stations (position C) for engagement with the advancing tape strips. This winding mandrel advance sequence is shown in FIGS. 6 and 13. As this winding mandrel indexing occurs, the enveloper and knife assemblies are pivoted toward each empty winding mandrel in its winding station. This pivoting is begun as a function of the amount of web material 126 that has been advanced, as monitored by the length encoder 202.

In FIG. 13, the enveloper assemblies are shown to have advanced sufficiently to engage the tape strips advancing from the anvil roller 48 to the winding tape rolls on winding mandrels 55*a* and 60*a*, and the knife assemblies are ready to envelop the winding mandrel and advancing tape strips when the presence of a liner/tab strip on the advancing tape strips is detected. This is accomplished by means of optical sensors, such as sensors 288 and 290 mounted on the enveloper assemblies 56 and 61, respectively. Thus, for example, when a leading edge of the liner/tab strip 204 is detected by the sensor 288, the upper enveloper and knife assemblies 56 and 57 are pivoted together to fully envelope the empty winding mandrel 55*b* and adjacent portions of advancing strips 50. The sensor 290 operates in a similar manner to detect a leading edge of the liner/tab strip 205 for triggering the final pivoting together of the lower enveloper and knife assemblies 61 and 62.

The sequence of tape cut-off and winding about a winding mandrel is illustrated specifically in FIGS. 14*a*–14*l*. These figures and this discussion illustrate the upper enveloper and knife assemblies 56 and 57 and their operation. Other than orientation, the operation of the lower enveloper and knife assemblies 61 and 62 functionally is the same, as is the construction of those assemblies.

Figure 14A:
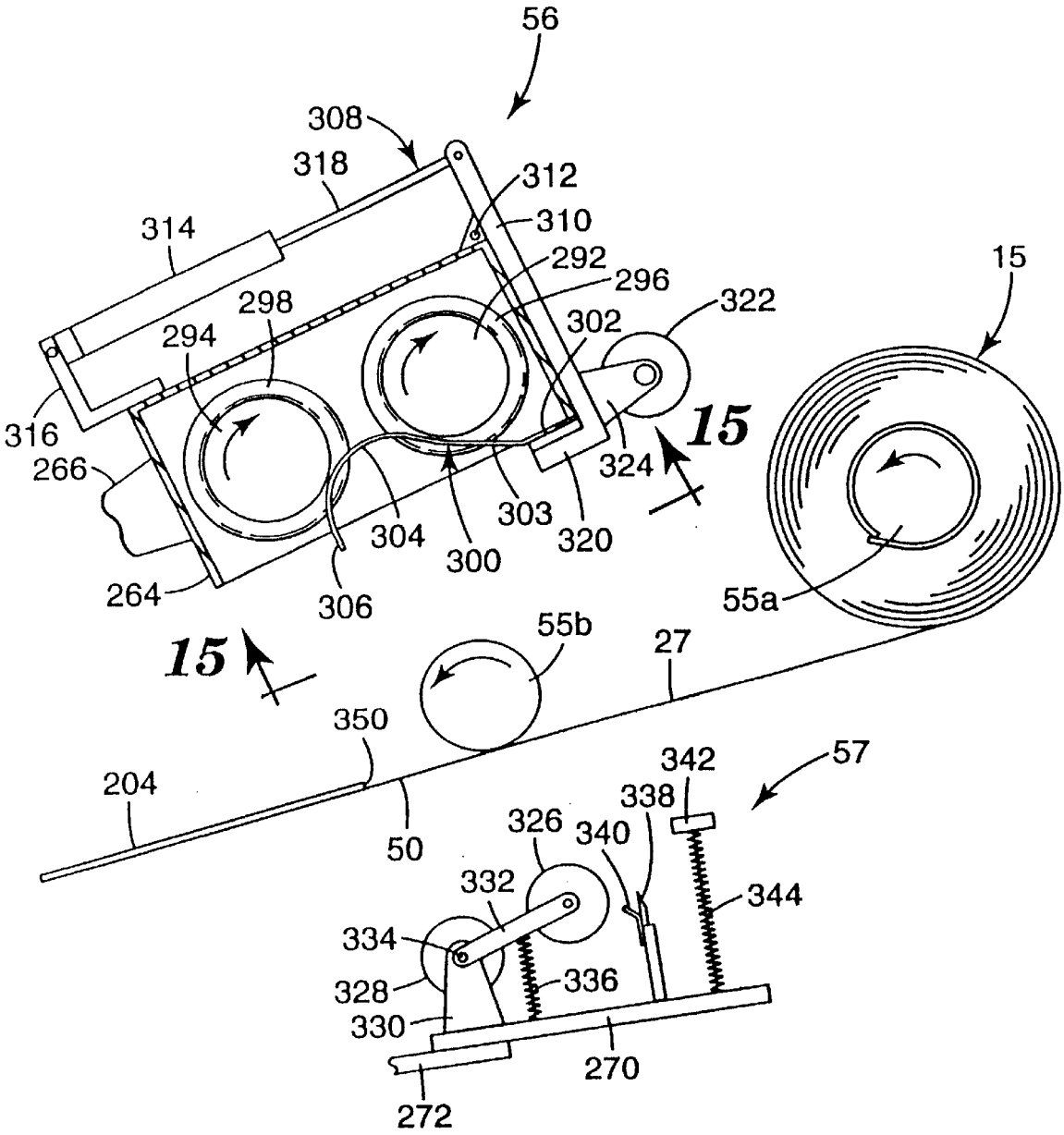
FIGS. 14*a*–14*l* are schematic views, partly in section and partly in elevation, of the enveloper assemblies used for severing the advancing tape strips and initiating winding about the winding mandrel, in the apparatus and method of the present invention.
Figure 14B:
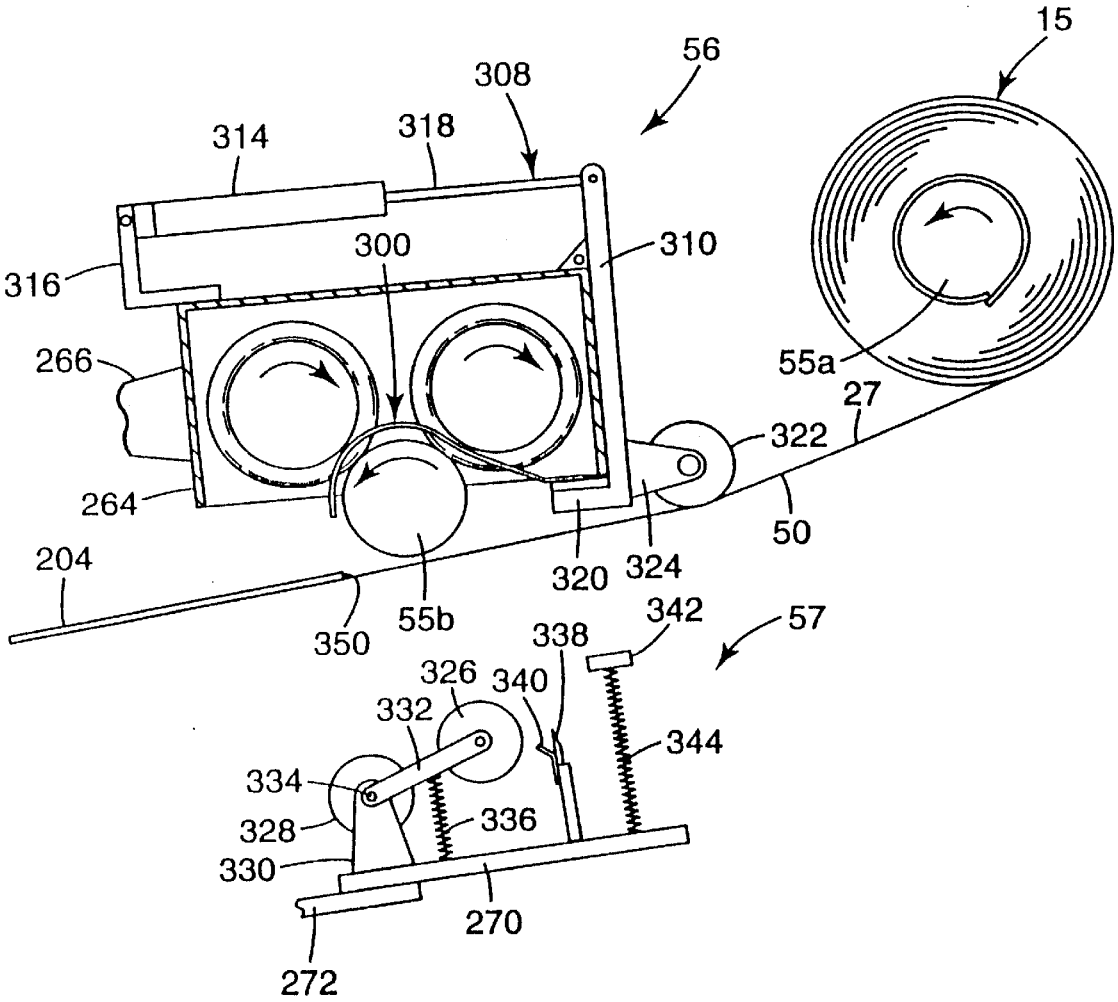
Figure 15:
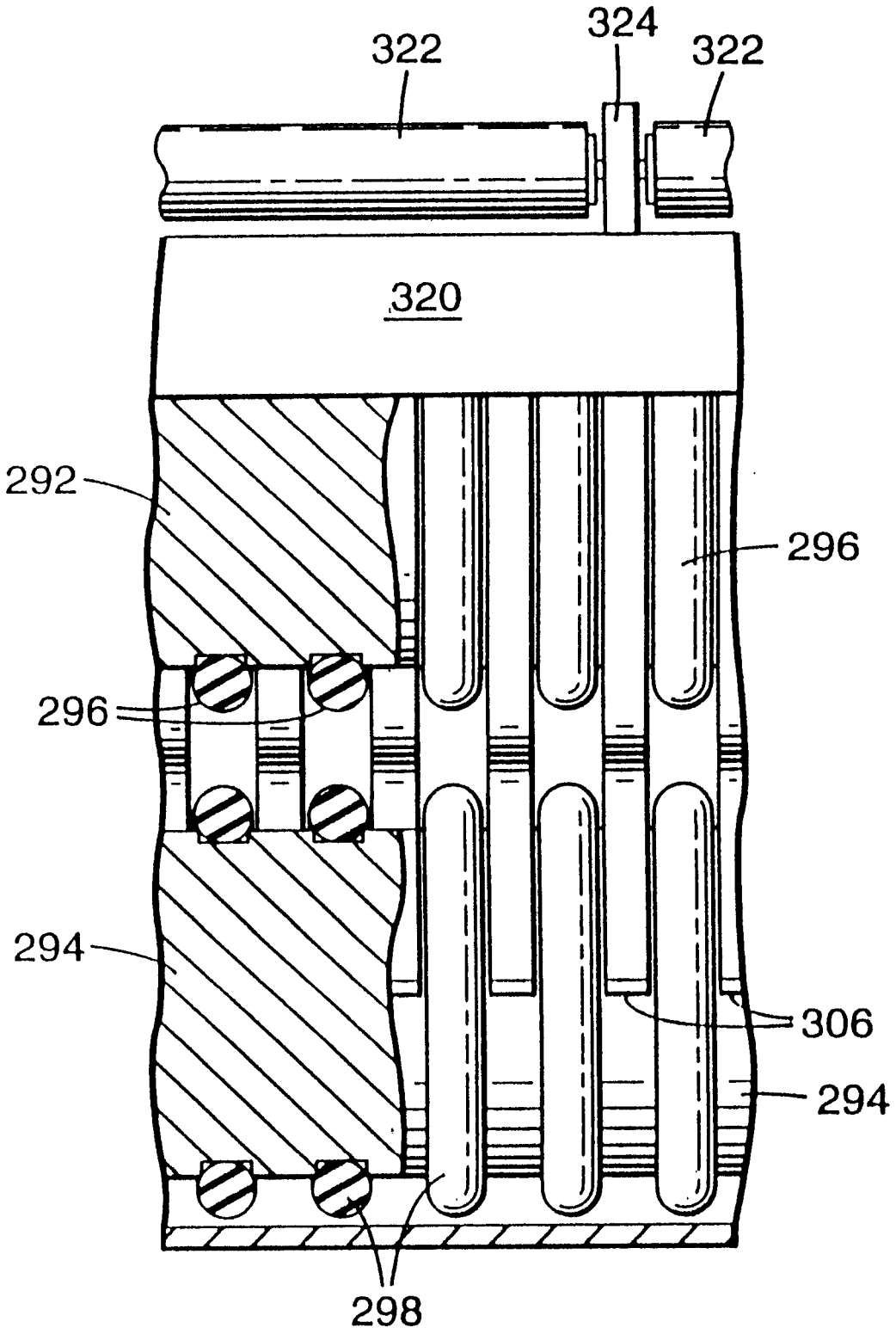
FIG. 15 is a partial elevational view as taken along lines 15—15 in FIG. 14*a*.

The upper enveloper assembly 56 has a strand feed roller 292 and a cinch roller 294 (FIG. 14*a*). The circumferential surface of the strand feed roller 292 is defined by a plurality of laterally spaced apart silicone rubber O-rings 296. Likewise, the circumferential surface of the cinch roller 294 is defined by a plurality of laterally spaced apart silicone rubber O-rings 298. The strand feed and cinch rollers 292 and 294 are rotatably supported from the enveloper frame 264 and are driven to rotate in an opposite direction from the rotation of the winding mandrel 55*b*. The strand feed and cinch rollers on each enveloper assembly are rotatably driven by a common motor (not shown) which is carried by the enveloper frame 264. As illustrated in FIGS. 14*a* and 15, a plurality of strand guide fingers 300 are laterally spaced across the upper enveloper assembly 56. Each strand guide finger 300 extends between adjacent O-rings 296 on the strand feed roller 292, and likewise between adjacent O-rings 298 on the cinch roller 294. Each strand feed guide 300 is mounted at its base 302 to the enveloper frame 264, and has a first bridge portion 303 between its base 302 and the strand feed roller 292, and a second bridge portion 304 between the strand feed roller 292 and cinch roller 294 (see FIG. 15). Each strand feed guide 300 then has a distal finger portion 306 extending generally outwardly from the cinch roller 294. The distal portions of the strand feed guide 300 are shaped to envelop the empty winding mandrel 55*b*, as illustrated in FIG. 14*b*.

A tail-winder assembly 308 is also carried upon the enveloper assembly 56. The tail-winder assembly 308 includes an arm 310 pivotally mounted to the enveloper frame 264 at pivot axis 312. An upper end of arm 310 is pivotally connected to a linear actuator 314, such as a pneumatic cylinder which is pivotally mounter at its cylinder end to a support 316 fixed to the enveloper frame 264. An extensible rod 318 of the actuator 314 is extended and pivotally coupled to an upper end of the arm 310 of the tail-winder assembly 308. At its lower end, the arm 310 has a laterally extending anchor plate 320 which is adapted to engage the tape strips 50. Lay-down rollers 322 are also pivotally mounted to the arm 310 adjacent its lower end, by a plurality of supports 324.

The upper lay-on roller and knife assembly 57 includes first and second lay-on idler rollers, 326 and 328, which extend laterally across the tape strip travel path and are release coated. The second lay-on idler rollers 328 are rotatably mounted to knife frame 270 by supports 330. The first lay-on idler rollers 326 are rotatably supported by support arms 332, which are pivotally mounted to supports 330 as at lateral pivot axis 334. The support arms 332 and first lay-on idler rollers 326 are biased away from the knife frame 270 by suitable bias means such as springs 336.

A laterally extending tape knife blade 338 is mounted to the knife frame 270 adjacent the first lay-on idler rollers 326. A laterally extending tape tuck plate 340 is mounted adjacent the tape knife blade 338, between the tape knife blade 338 and first lay-on idler rollers 326. A laterally extending tape pinning bar 342 is also supported by the knife frame 270 adjacent the tape knife blade 338. The tape pinning bar 342 is biased away from the knife frame 270 by suitable bias means such as springs 344.

4. Cut-Off and Winding Operations

FIG. 13 illustrates the upper enveloper and knife assemblies 56 and 57 immediately prior to their complete envelopment of the empty winding mandrel 55*b*. This relationship is also shown in greater detail in FIG. 14*b*. During the operation of the cut-off and winding assembly, a plurality of tape strips can be simultaneously processed in relation to a single winding mandrel. For clarity of illustration, however, the following discussion will relate to the processing of a single tape strip.

Figure 14C:
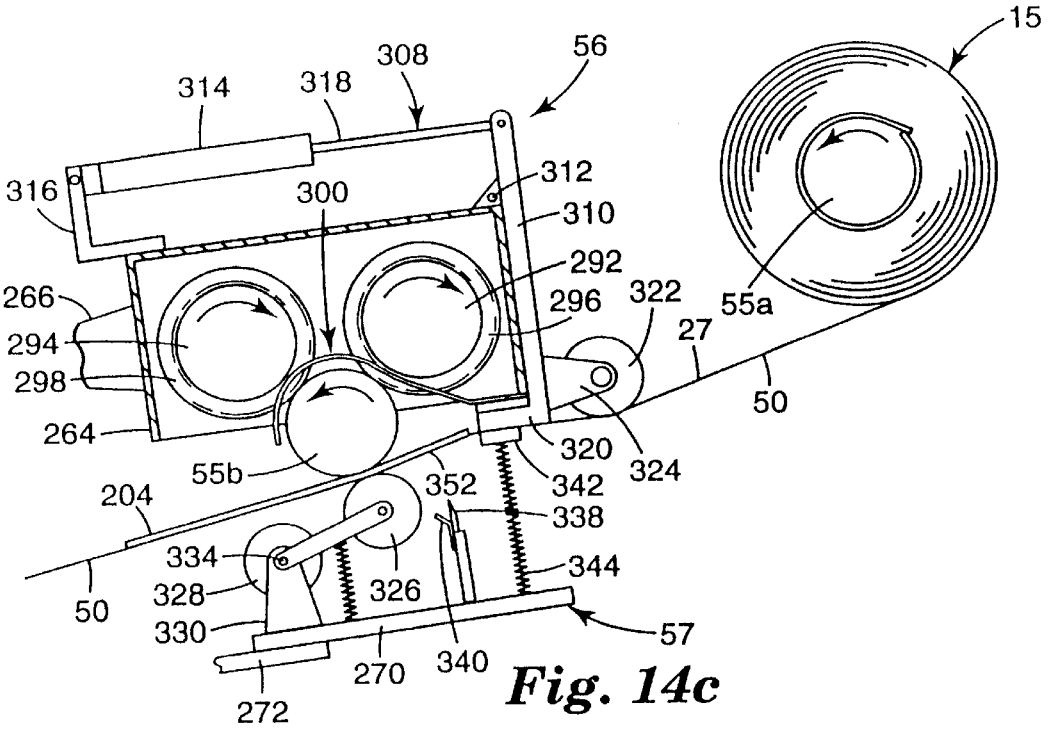

Upon detection of a leading edge 350 of the liner/tab strip 204, the enveloper and knife assemblies 56 and 57 are pivoted together about the empty winding mandrel 55*b*, as illustrated in the sequence of FIGS. 14*a*–14*e*. In 14*a*, the enveloper assembly 56 and knife assembly 57 are shown approaching the empty winding mandrel 55*b*, which momentarily contacts the advancing tape strip 50. In FIG. 14*b*, the enveloper assembly 56 is shown contacting the rotating empty winding mandrel 55*b*, with its lay-down roller 322 (which is release coated) engaging the advancing tape strip 50 to push it away from the winding mandrel 55*b*. This prevents the adhesive on the tape strip 50 from unnecessarily running over the compressible material layer 246 on the winding mandrel 55*b*. In FIG. 14*c*, the enveloper assembly 56 and knife assembly 57 are shown first contacting tape strip 50 for tape cutting. Specifically, the adhesive side 27 of the tape strip 50 has contacted and adhered to the anchor plate 320 of the arm 310 on enveloper assembly 56, and the tape strip 50 is contacted on its opposite side by the tape pinning bar 342 of the knife assembly 57. At the same time, the first lay-on idler roller 326 engages the tape strip 50 opposite the rotating winding mandrel 55*b*.

Figure 14D:
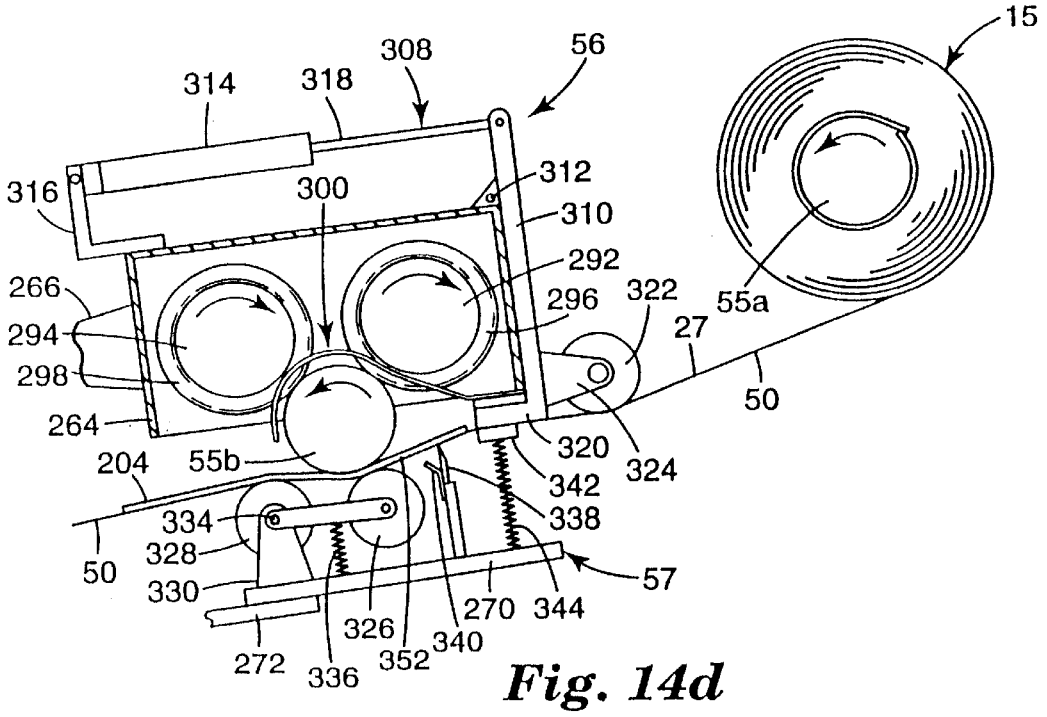
Figure 14E:
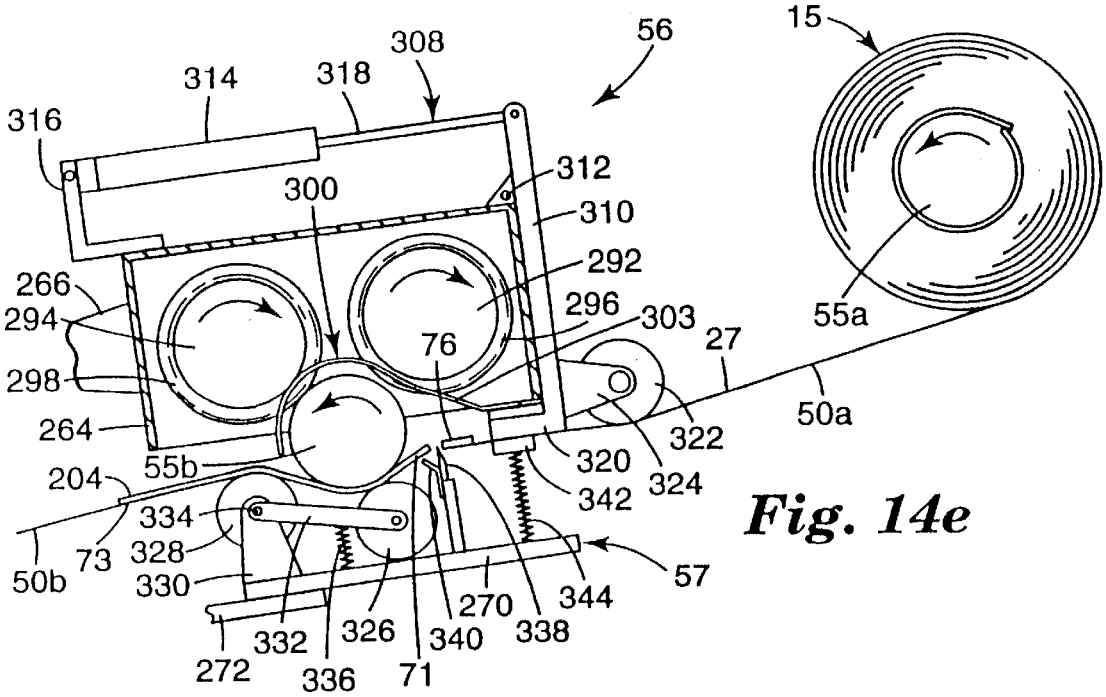

As the enveloper and knife assemblies 56 and 57 continue to merge together about the winding mandrel 55*b*, the springs 336 and 344 exert pressure against the first lay-on idler roller 326 and tape pinning bar 342, respectively. This secures a segment 352 of the tape strip 50 therebetween for cutting. As seen in FIGS. 14*c* and 14*d*, the tape strip segment 352 (bearing a leading part of the liner/tab segment 204 thereon) is held in tension as the tape knife blade 338 engages it. As seen in FIG. 14*e*, when the enveloper assembly and knife assembly 56 and 57 are fully coupled to envelop the winding mandrel 55*b*, the tape knife blade 338 has severed the segment 352 of the tape strip 50. The springs 336 are in compression, urging the first lay-on idler rollers 326 against the winding mandrel 55*b*. The springs 344 are also in compression, urging the tape pinning bar 342 against the anchor plate 320. The tape strip 50 is now defined as two tape strips 50*a* and 50*b* (FIG. 14*e*), where tape strip 50*a* is almost fully wound about winding mandrel 55*a*, and tape strip 50*b* is just beginning to be wound about winding mandrel 55*b*.

During this severing process, the anchor plate 320 and tape pinning bar 342 cooperate to secure an adhesive bearing portion of the tape strip 50*a* just ahead of the liner/tab strip 204. Thus, when the tape knife blade 338 severs the liner/tab strip 204, it defines, on the one hand, a segment 76 of the liner/tab strip 204 at the trailing end of the tape strip 50*a* which is being wound onto the winding mandrel 55*a*. Referring again to FIG. 2, this segment 76 masks the adhesive at the trailing end of the tape strip, thereby defining a tape tab portion 75. The remainder of the liner/tab strip 204 is wound about the winding mandrel 55*b* to form the innermost wrap 72 of a next tape roll 15 to be formed, and constitutes its liner 73 (FIG. 2). Further, the cutting defines the leading edge 71 of the innermost wrap 72 that will be defined by the liner 73, which is being directed about the winding mandrel 55*b*.

At all times while the tape strip 50*a* is held between the anchor plate 320 and tape pinning bar 342 (e.g., FIGS. 14*c*–14*h*), the first winding mandrel 55*a* continues to rotate, thereby placing the tape strip 50*a* between the tape roll 15 and the enveloper and knife assemblies 56 and 57 in tension. The winding mandrel 55*a* in FIGS. 14*a*–14*k* is in position D on the upper turret assembly 65, and while the winding mandrel shaft 210 of the winding mandrel 55*a* in this position continues to rotate, the core tube 234 about which the tape roll 15 is wound slips rotatably on the shaft 210 of the winding mandrel 55*a* to hold the tape roll 15 in the position illustrated by FIGS. 14*c*–14*h*.

Figure 14F:
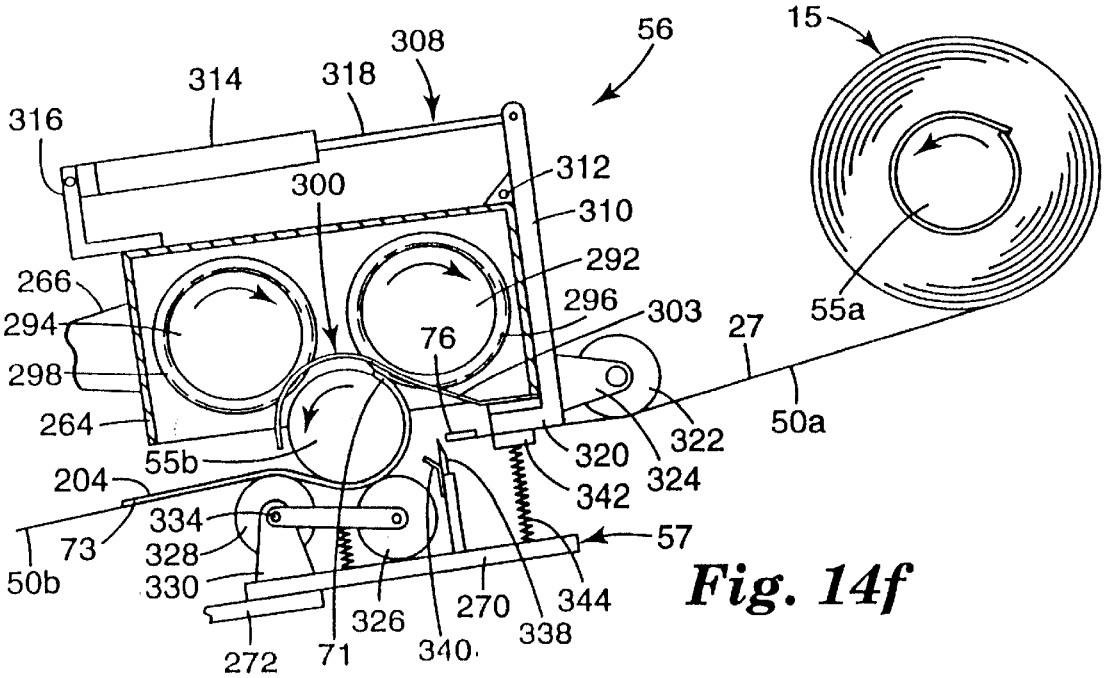
Figure 14G:
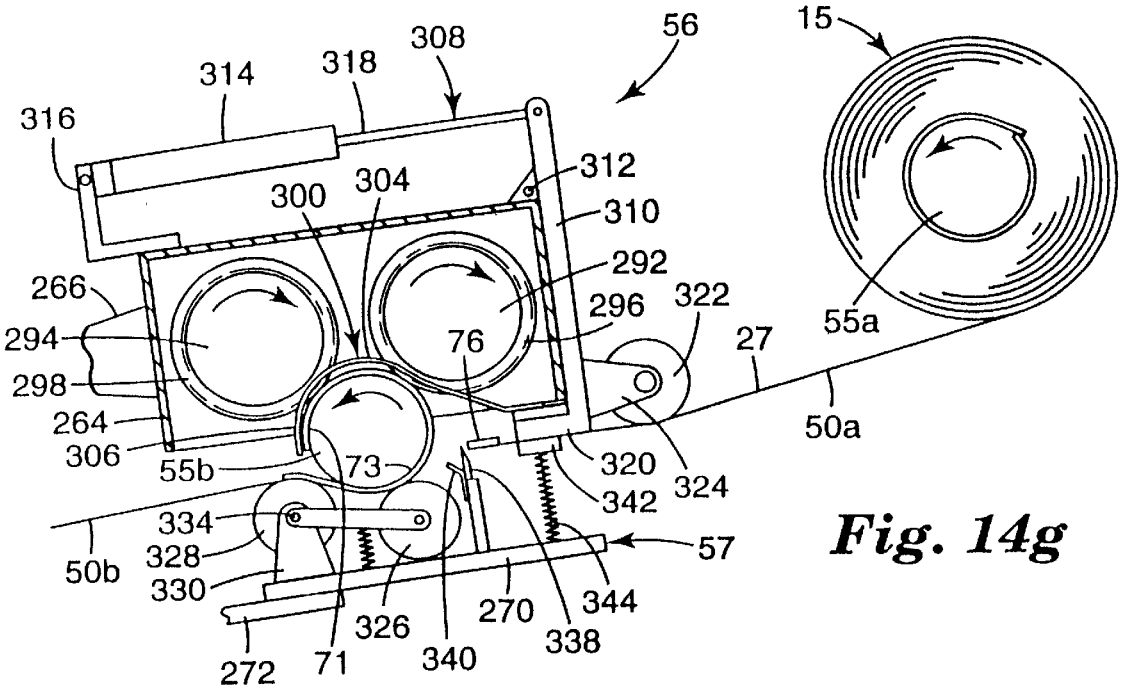
Figure 14H:
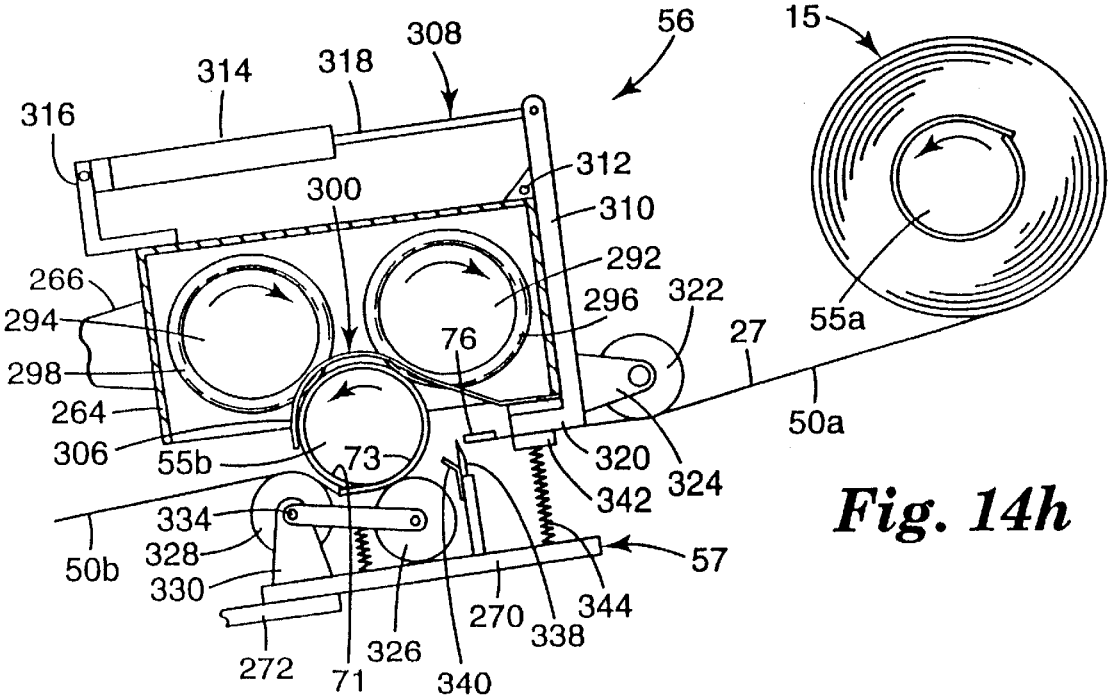

The actual winding of the innermost wrap of a tape roll about winding mandrel 55*b* is illustrated in the sequence of FIGS. 14*d*–14*g*. As seen in FIG. 14*e*, the tape tuck plate 340 urges the just-severed leading end of the next tape roll to be formed (edge 71) upwardly toward the nip defined by the winding mandrel 55*b* and the O-rings 296 on the strand feed roller 292. The first bridge portion 303 of the strand feed guide 300 also aids in directing that leading end into that nip. In FIG. 14*f*, the leading edge 71 is seen in the nip between the winding mandrel 55*b* and O-rings 296 of strand feed roller 292. The second bridge portion 304 of the strand feed guide 300 aids in feeding the leading edge 71 into the nip between the winding mandrel 55*b* and O-rings 298 of the cinch roller 294. In FIG. 14*g*, the leading edge 71 has now passed through the nip between the winding mandrel 55*b* and the O-rings 298 of the cinch roller 294. The distal finger portion 306 of the strand feed guide 300 aids in guiding the leading edge 71 into an underlying relationship to the trailing portion of the innermost wrap (liner 73) and the adhesive side of the tape strip 50*b* following it. The second lay-on roller 328 is aligned to urge the tape strip 50*b* into the largest possible contact are about the winding mandrel 55*b*, thereby defining the overlap of advancing tape strip 50*b* onto the innermost wrap as close as possible to the distal finger portion 306. Finally, in FIG. 14*h*, the leading edge 71 is seen as now over wrapped by the trailing end of the innermost wrap (formed by the liner 73). As the winding continues, the adhesive side 27 of the tape strip 50*b* contacts the liner 73 and is urged against it by the, first lay-on idler roller 326 (which, although it has been pushed toward the knife frame 270, continues to be freely rotatable) to adhere thereto and secure the innermost wrap diameter about the winding mandrel 55*b*.

To facilitate the feeding of the leading end 71 of the liner 73 about the winding mandrel 55*b* and into the path defined by the strand feed guide 300 thereabout, in one alternative the first lay-on idler rollers 326 are driven at a rate faster than line speed and faster than the rate of rotation of the winding mandrel 55*b*. This tends to direct the leading end 71 away from the driven lay-on rollers 326 and up toward the travel path defined by the strand feed guide 300 about the rotating winding mandrel 55*b*.

The strand feed and cinch rollers 292 and 294 are driven to rotate at a much faster circumferential speed than the line speed and rate of rotation of winding mandrel 55*b*, Thus, when the liner 73 engages the strand feed and cinch rollers 292 and 294, it is forced under increased tension into the nip between those rollers and the winding mandrel 55*b* and pulled relative to the line speed of the tape strip 50*b*. The increased rate of rotation of the strand feed and cinch rollers 292 and 294 also tends to direct the leading end 71 away from the strand feed and cinch rollers 292 and 294, about the winding mandrel 55*b* and under the trailing edge of the liner 73. The strand feed roller 292 is driven via a one-way clutch to allow over-rotation caused by the cinch roller 294.

The increased tension placed on the innermost wrap (liner 73) as it is wound about the core tube 234 compresses the material layer 246 (via bending of stems 248, as seen in FIGS. 1 and 12), thereby defining the inner diameter of the innermost wrap. The material layer 246 is compressible under shear applied tangentially to its outer surface (stems 248) by the innermost wrap of tape as it is wound about the winding mandrel 55*b* in tension. The innermost wrap is thus pulled or cinched in tension about the winding mandrel 55*b* to a desired position, and this tension is held and maintained when the adhesive on the tape strip 50*b* is wrapped about and secures the innermost wrap in place (preferably, the length of the liner 73 is slightly longer than the circumference of the cinched innermost wrap). The action of the strand feed rollers 292 and cinch rollers 294 and the winding mandrel 55*b* cause the innermost wrap to tighten about the winding mandrel 55*b* for a short time. As soon as the adhesive 27 on the advancing tape strip 50*b* contacts the wound liner 73, the increased pulling ceases, forming an interference fit of tape strip 5O*b* around, the winding mandrel 55*b*. The core tube 234 may rotatably slip relative to the winding mandrel shaft 210 during this process. The end result is a relatively tightly wound innermost wrap of the tape strip, and specifically the leading portion of the tape strip covered by liner/tab material (liner 73), with successive windings of adhesive-bearing tape strip thereon. During further processing, the tape roll does not slip rotatably relative to the core tube 234, but the core tube 234 may slip rotatably relative to the winding mandrel shaft 210 (and indeed, is designed to do so).

Figure 14I:
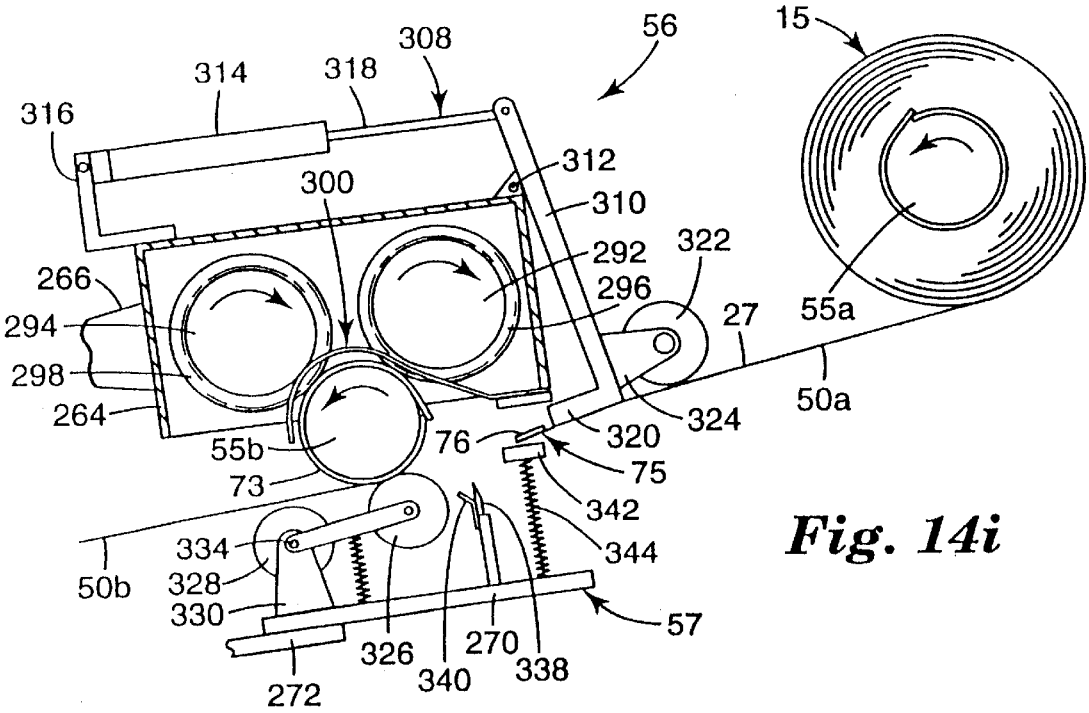
Figure 14J:
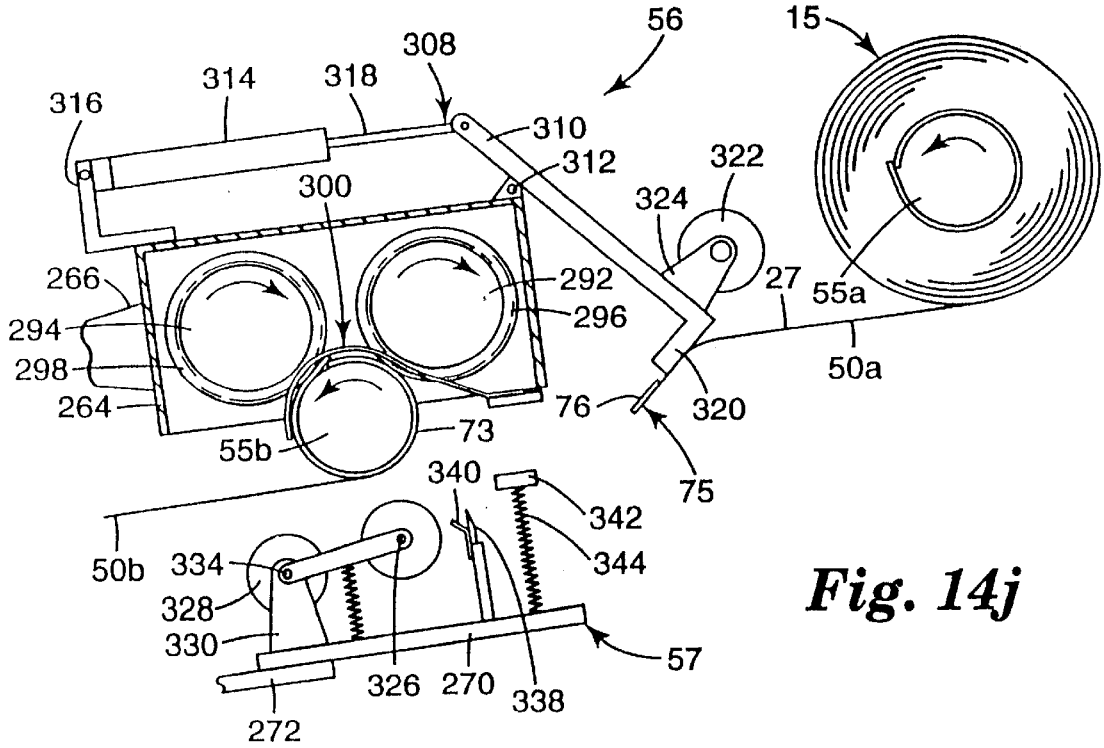
Figure 14K:
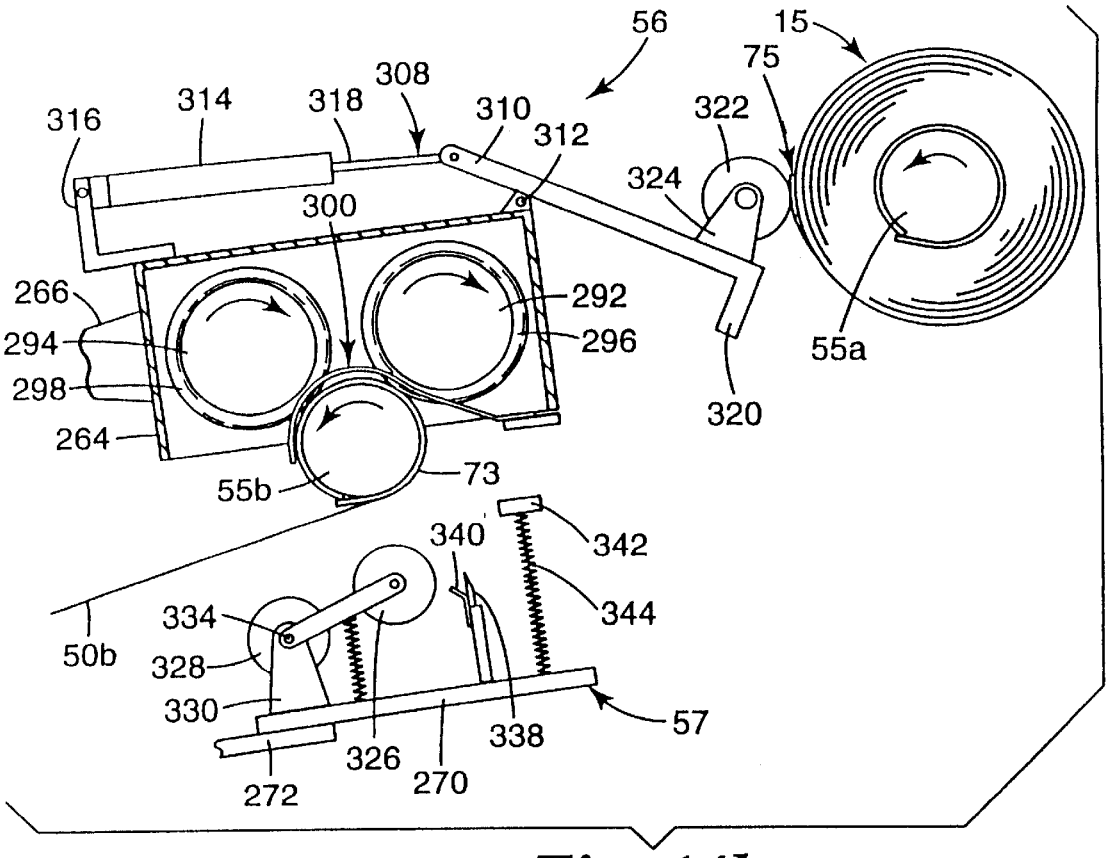

After the initial wrap of tape strip 50*b* around the winding mandrel 55*b* is completed (FIG. 14*h*), the enveloper assembly 56 and knife assembly 57 pivot about pivot axis 268 to separate and disengage from the winding mandrel 55*b*. As seen in FIG. 14*i*, once the enveloper and knife assemblies 56 and 57 are sufficiently separated to disengage the anchor plate 320 and tape pinning bar 342, the tension placed on the tape strip 50*a* by rotation of winding mandrel 55*a* pulls on the arm 310. The arm 310 is free to pivot about pivot axis 312, and thus pivots toward winding mandrel 55*a*, while rod 318 retracts into cylinder 314. The tape strip 50*a* leading to winding mandrel 55*a* remains adhered to the anchor plate 320 initially, as illustrated in FIG. 14*i*. The winding mandrel 55*a* continues to rotate, and because the tape strip 50*a* is no longer held to the enveloper assembly 56, the remainder of tape strip 50*a* starts winding onto tape roll 15 on winding mandrel 55*a* and pulling arm 310 toward winding mandrel 55*a*. Thus, the rotational slippage of core tube 234 under the tape roll 15 on winding mandrel 55*a* slows as the tape roll 15 on the winding mandrel 55*a* again begins to rotate with the winding mandrel 55*a*. Eventually, the angular orientation of the anchor plate 320 and remaining strand of tape strip 50*a* causes the adhesive side 27 of the tape strip 50 to peel off of the anchor plate 320, as illustrated in FIG. 14*j*. Finally, the arm 310 is pulled to a position wherein the lay-down roller 322 engages the outer circumferential surface of the tape roll 15 as it rotates, thereby wiping or rolling over the outermost layer thereof (FIG. 14*k*). The cylinder 314 holds it in this position momentarily and is then actuated to extend rod 318 and pivot arm 310 back in place on the enveloper frame 264. The enveloper assembly 56 may dwell momentarily on the winding mandrel 55*b* as the arm 310 is pivoted out and back (as shown), or the arm 310 may move during the pivoting away of the enveloper assembly 56 from the winding mandrel 55*b*.

The enveloper and knife assemblies 56 and 57 continue pivoting away from winding mandrel 55*b* until fully retracted from the winding mandrel path defined by the upper turret assembly 65. At the same time, the rate of rotation of the winding mandrel 55*b* is accelerated to achieve rapid winding of the tape strips 50*b* thereon. The winding mandrel 55*b* is rotated at a rate faster than the line speed of the advancing web material 26. Thus, winding mandrel rotation places the tape strip 55*b* under tension during winding, although less tension than placed on the tape strip 55*b* by the enveloper assembly 56 during initial wrap winding. The torque applied to each of the caliper compensating core tubes 234 is constant, as moderated by the force of compression spring 228 on the independently rotatable core tubes 234.

Figure 14L:
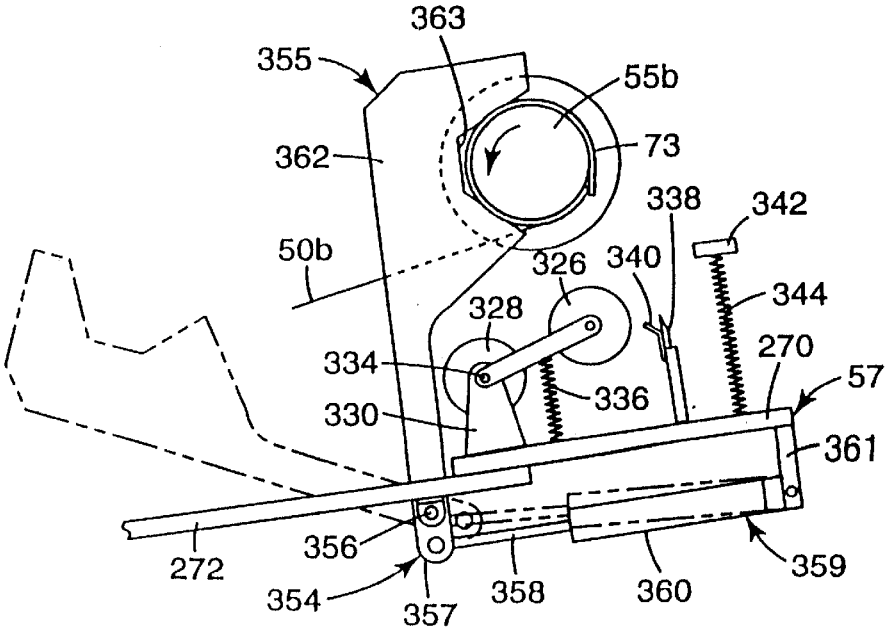

FIG. 14*l* illustrates a winding mandrel stabilizing assembly 354 which is carried on the upper knife assembly 57. The winding mandrel stabilizer assembly 354 is not shown in the other drawing figures for clarity. The winding mandrel stabilizer assembly 354 includes a stabilizer finger 355 which is pivotally mounted, as at lateral pivot axis 356, to the knife assembly 57. At its lower end 357, the stabilizer finger 355 is pivotally coupled to an extensible rod 358 of a linear actuator 359. The linear actuator 359 has a cylinder portion 360 which is in turn pivotally mounted to the knife frame 270 by a support 361. An upper end 362 of the stabilizer finger 355 is formed with a socket 363 adapted to engage one of the spacer tubes 232, preferably adjacent the midpoint of the rotating winding mandrel 55*b*. The lateral width of the stabilizer finger 355 is less than a width of the tape strips 50*b* being wound upon the winding mandrel 55*b*, which allows the stabilizer finger 355 to extend between adjacent tape strips 50*b* being wound on the winding mandrel 55*b*. One or more stabilizer fingers 355 may be provided along the winding mandrel, depending on the width and rotational rigidity of the winding mandrel.

At the desired high rate of rotation for winding mandrel 55*b* during tape winding, the stabilizer finger 355 acts to prevent undesired oscillation of the rotating winding mandrel 55*b* between its chucks. The actuator 359 is normally positioned with its arm retracted, so the stabilizer finger 355 assumes a position such as shown in phantom in FIG. 14*l*. Upon withdrawal of the upper enveloper assembly 56 from adjacent the winding mandrel 55*b* (after the innermost wrap has been formed and secured), the linear actuator 359 is activated to extend rod 358 and thus pivot the stabilizer finger 355 into engagement with the rotating winding mandrel 55*b*, as seen in FIG. 14*l*. When a tape roll 15 is nearly completely wound on winding mandrel 55*b* (an "in-process" tape roll), and the winding mandrel 55*b* is indexed to its next position D on the upper turret assembly 65, the stabilizer finger 355 is withdrawn to allow the indexing of an empty winding mandrel from its ready position B into the winding position C.

During winding of the tape strip on winding mandrel 55*b*, the tape winding and cutting components resume the relative orientation illustrated in FIG. 6. After the enveloper assembly 56 has returned to its position illustrated in FIG. 6, an empty winding mandrel in position A is then indexed to the ready position B to begin the sequence anew. The strand feed and cinch rollers are not driven when the enveloper assembly 56 is in its ready position of FIG. 6. However, as soon as the enveloper assembly 56 begins pivoting toward the winding mandrel 55*b*, the drive motor borne thereon for the strand feed and cinch rollers is activated. Likewise, that motor is deactivated as soon as the enveloper assembly starts pivoting away from the winding mandrel 55*b*.

The winding mandrel 55*a*, now bearing a plurality of completed tape rolls 15, is no longer rotatably driven, and its chucks are indexed from transfer position D to unload position E on the upper turret of assembly 65. After a winding mandrel has been removed from the chucks of its turret assembly, with completed tape rolls 15 thereon, the tape rolls are extracted from the winding mandrel by sliding them axially along the winding mandrel (as in directions of arrows 365 in FIG. 12). The pliant stems 248 bend to permit axial movement of the tape roll 15 relative to the winding mandrel shaft 210, and then after the tape roll 15 has passed, the stems resume their original upstanding position (as illustrated by section 258 of stems 248 in FIG. 12).

The sequence of events illustrated in FIGS. 14*a*–14*l* happens quite quickly. The advance of the tape strip 50 is not stopped to perform the cutting and initial winding operations illustrated in FIGS. 14*a*–14*l*. The advance of the tape strip 50 is slowed to a speed lower than its winding speed, but it is not necessary to completely stop and then restart the tape strip advance.

Process Control

As described above, there are numerous motors and actuators which must be precisely controlled to achieve the desired coreless tape roll winding. System control is preferably achieved through use of a microprocessor, which is operatively coupled to the various motors to control their actuation and speeds, and to the various activators to control their manipulation. For example, in the tab applicator 37, the processor will actuate the motor 104 based upon signals received from the optical sensors 186 and 188. Likewise, the knife actuator 118 in the tab applicator 37 is activated based upon signals received from the processor by the optical sensors 186, 188, as is the clutch 113, and also the operation of hydraulic cylinder 176. Similarly, the processor controls the motor for advancing the web material through the apparatus, the motors for the turret assemblies, the motors for rotating the winding mandrels and the motors on the enveloper assemblies. In addition to the sensors and length encoder mentioned, it will be understood by those skilled in the art that further sensors may be provided as is typical to control the operation and coordination of such assemblies in a system of this type and complexity.

EXAMPLE

In one embodiment of the present invention, a supply roll of web material is provided with a nominal width of 60 inches. The tape is formed from a starting supply roll material of box sealing tape, TARTAN brand No. 371, having a thickness of 0.002 inch, manufactured by Minnesota Mining and Manufacturing Company of St. Paul, Minn. After processing through an apparatus such as illustrated herein, 31 tape rolls are formed, and each finished tape roll is 48 mm wide and bears approximately 100 meters of tape. The finished tape roll has an inner diameter of 25 mm and an outer diameter of about 3.25 inches. The line speed for tape winding (e.g., FIG. 6) may be, for example, 500 feet per minute, with a slow down for cut-off and the start of winding at about 3 feet per minute. During winding, the winding mandrel is rotated at a 5–10% faster rate than the web material advance speed. In addition, the winding mandrel rotation rate during winding varies depending upon the outer diameter of the tape roll wound on the winding mandrel, as controlled by the processor, in order to slightly exceed the web speed. That diameter is dependent upon the thickness of the web material and the tension placed thereon during winding. Initial web tension (at the start of the winding sequence for a tape roll) is ⅔ to ¾ lb/lineal inch width, and the tape rolls are wound in a constant torque mode on the winding mandrel. In this example, the core tubes on the winding mandrels were covered with SCOTCHMATE® pressure sensitive backing hook material, manufactured by Minnesota Mining and Manufacturing Company of St. Paul, Minn., Part No. 70-0704-2795-3, and each DELVIN® core tube had an outer diameter of 0.875 inches. The strand feed and cinch rollers were rotated, during winding of the innermost wrap, at 3–5 times the web material advance speed. In making the tape rolls of this example, the tape has a single adhesive side and is wound with its adhesive side facing the winding mandrel axis. A paper liner/tab having a thickness of 0.003 inch and a length along the travel path of the web material of 3.75 inches is provided. Once severed, approximately 3.25 inches of the liner/tab defines the liner for the tape roll, while the remainder of the liner/tab defines the tape tab portion at the outermost end of a previously formed tape roll.

Although the present invention has been described with reference to preferred embodiments, workers skilled in the art will recognize that changes may be made in form and detail without departing from the spirit and scope of the invention. Thus, the scope of the present invention should not be limited to the apparatus and procedures described herein, but rather by the apparatus and methods described by the language of the claims, and their equivalents.

For example, the compressible and pliant material layer on the core tubes of the winding mandrel may also be used to facilitate the formation of a coreless roll of pressure sensitive adhesive tape using a level winding technique, rather than a concentric winding technique. In this instance, the adhesive liner on the tape strip being wound is sufficiently long to mask adhesive on the first pass of the level winding process, which defines the innermost spiral wrap on the tape roll ultimately formed thereby.

It is also contemplated that tape rolls be formed with no tape tab portion. In this instance, the cut-off and winding assembly is controlled to sever the advancing tape strip at the leading lateral edge of the liner/tab, thereby placing no liner/tab material on the trailing edge of the severed tape strip which is ultimately wound as the outermost wrap and edge of a finished tape roll. Thus, all of the liner/tab is used to form the liner of the tape roll being wound on the winding mandrel.

In another embodiment, a small lateral strip of the leading edge of a tape roll being wound on the winding mandrel is bent back upon itself as it is wound around the winding mandrel. As that bent-over lateral strip is wound about the winding mandrel, it then first engages the adhesive of the advancing tape strip. Thus, the leading edge itself is not exposed, but rather sandwiched and secured between the first and second innermost wraps of the tape roll being formed. This arrangement thus reduces the possibility that an underlapping portion of the leading edge is unadhered and thus prone to catch and become inadvertently peeled from the tape roll.

Although discussed primarily above in the context of pressure sensitive tape having adhesive on one side thereof, with the adhesive being wound on the inner side of the tape windings, it is contemplated that the inventions defined herein are applicable to form coreless rolls of tape wound in an opposite configuration (with the adhesive side facing out), as well as to form coreless rolls of pressure sensitive adhesive tape transfer materials and double-sided pressure adhesive tape. It is understood that the winding of coreless tape rolls with the adhesive side facing away from the winding mandrel winding axis will result in some different process considerations. For instance, when a liner is provided which masks the adhesive on the innermost wrap of such tape, the adhesive on the tape will not engage successive windings thereof until the initiation of the third wrap of tape about the winding mandrel. Thus, it will be necessary to maintain the increased tension on the tape as it is wound for two initial wraps about the winding mandrel in order to cinch the tape about the winding mandrel using its own adhesive. In that regard, the roller and O-rings on the cut-off and winding assembly must necessarily be release coated or formed of a suitable material (i.e., silicone rubber) because they will be contacting the adhesive bearing side of the tape. Because the adhesive is on an opposite side of the tape, the tail-winder assembly 308 must be reconfigured, since there would be no adhesion of the severed tape to the anchor plate, but rather to the pinning bar 342. Further, because the outermost wrap of a finished tape roll would have its adhesive on its outer surface, the length of the liner/tab may be extended so that the segment thereof which previously formed the tape tab portion is long enough to extend about the entire outermost wrap of the finished tape roll, thereby masking exposed adhesive thereon. Pressure sensitive adhesive tape wound with its adhesive side out requires no liner on the innermost wrap to prevent adhesive from engaging the winding mandrel, since the non-adhesive side of the tape faces the winding mandrel. Thus, it is contemplated that no liner be provided for the innermost wrap, in which instance the adhesion by wrapping about the winding mandrel would begin with the second wrap. If a liner/tab is provided, the liner/tab maybe severed at its trailing lateral edge by the cut-off and winding assembly and serve only to mask the outermost wrap of a finished tape roll, rather than as a liner for an innermost wrap.

What is claimed is:

1. A method of forming a coreless roll of pressure sensitive adhesive tape comprising the steps of:

providing a first rotating winding mandrel in a first winding station;

directing a leading edge of an advancing strip of pressure sensitive adhesive tape around and directly against the first mandrel;

winding the tape successively upon itself and the first mandrel to form an in-process coreless tape roll;

advancing the first mandrel and in-process coreless tape roll thereon to a second transfer station while advancing a second rotating mandrel into the first winding station for engagement with the advancing tape;

severing the tape between the first and second mandrels to define a trailing edge of the tape wound upon the first mandrel;

winding the tape on the first mandrel in the second transfer station until the trailing edge is wound thereon to form a completed coreless tape roll on the first mandrel; and prior to the directing step, applying a liner/tab along a portion of the strip of pressure sensitive tape, on a side of the tape bearing adhesive, wherein the tape severing step cuts through that portion of the tape bearing the liner/tab so that a segment of the liner/tab masks a section of the adhesive adjacent the trailing edge of the tape wound upon the first mandrel.

2. The method of claim 1 wherein the tape severing step occurs adjacent the second mandrel and also defines a new leading edge of the advancing strip of tape, and further comprising:

directing the new leading edge around and directly against the second mandrel.

3. The method of claim 2, and further comprising:

removing the first mandrel and completed coreless tape roll thereon from the second transfer station;

winding the tape successively upon itself and the second mandrel for a plurality of wraps to form a second in-process coreless tape roll;

advancing the second mandrel and second in-process coreless tape roll thereon to the second transfer station while advancing a third rotating mandrel into the first winding station for engagement with the advancing tape;

severing the tape between the second and third mandrels to define a trailing edge of the tape wound upon the second mandrel;

winding the tape on the second mandrel in the second transfer station until the trailing edge of the tape wound upon the second mandrel is wound thereon to form a second completed coreless tape roll on the second mandrel; and removing the second completed coreless tape roll axially from the second mandrel without simultaneously changing the diameter of the second winding mandrel along the entire length thereof.

4. The method of claim 1, and further comprising:

forming at least a portion of a circumferential outer tape supporting surface of the first mandrel from a tape engaging surface portion that, in a radial dimension relative to an axis of the first mandrel, is compressible yet sufficiently stiff to support the tape as the tape is successively wound upon the first mandrel and that is sufficiently pliant to permit ready axial removal of the completed coreless tape roll from the first mandrel.

5. The method of claim 1 wherein the tape is wound with the side of the tape bearing adhesive facing toward the first mandrel.

6. The method of claim 1, and further comprising:

aligning the advancing strip of pressure sensitive tape with the first rotating mandrel so that an extent of the liner/tab masks the adhesive on the innermost wrap of tape wound on the first mandrel.

7. The method of claim 6 wherein the tape is wound with the side of the tape bearing adhesive facing toward the first mandrel.

8. The method of claim 6 wherein the tape is wound under a first tension, and further comprising:

placing that portion of the tape which defines the innermost wrap of tape around the first rotating mandrel under a second higher tension.

9. The method of claim 1, and further comprising:

supplying a web having first and second major surfaces, one surface bearing pressure sensitive adhesive thereon; and slitting the web longitudinally to define the strip of pressure sensitive adhesive tape therefrom.

10. The method of claim 9 wherein the slitting step defines a plurality of strips of pressure sensitive adhesive tape.

11. The method of claim 10, and further comprising:

providing two separate pairs of winding and transfer stations, and separate first and second mandrels for each pair of stations; and directing every other strip of tape from the web to alternate station pairs for forming into coreless rolls of pressure sensitive adhesive tape.

* * * * *

UNITED STATES PATENT AND TRADEMARK OFFICE

CERTIFICATE OF CORRECTION

PATENT NO. : 6,405,969 B1
DATED : June 18, 2002
INVENTOR(S) : Ogren, Harvey D.

Figure 11:
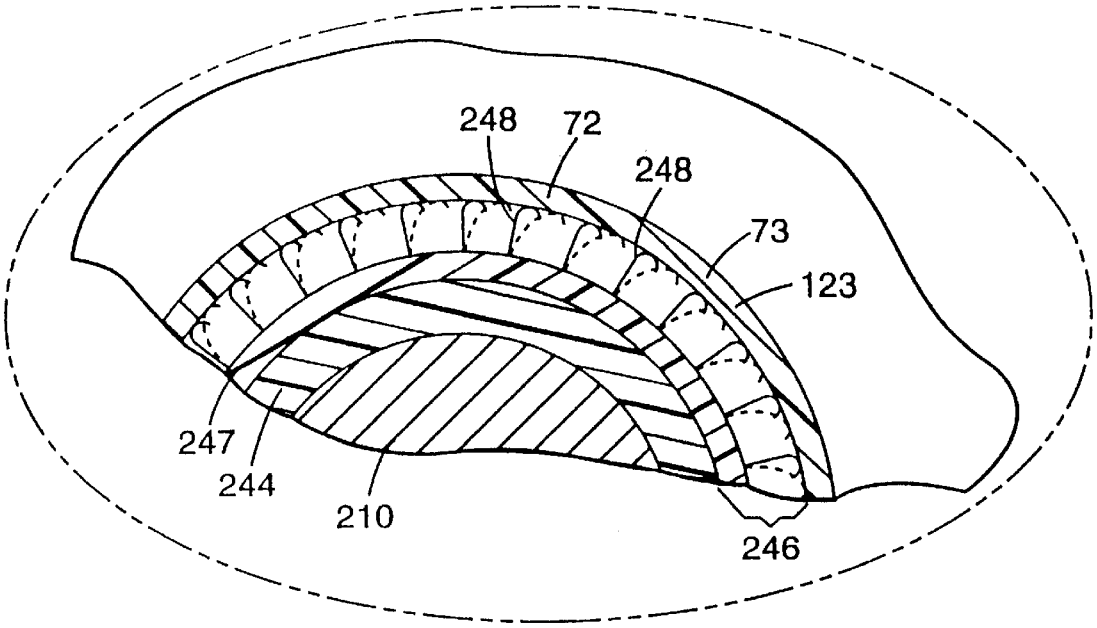
FIG. 11 is an enlarged sectional view of the encircled portion in FIG. 10, illustrating the compressibility of the winding mandrel material upon which tape is wound in the inventive method and apparatus.

It is certified that error appears in the above-identified patent and that said Letters Patent is hereby corrected as shown below:

Column 19,
Line 33, delete "FIGS. 1 and 12)," and insert in place thereof -- FIGS. 11 and 12), --.
Line 49, delete "5Ob" and insert in place thereof -- 50 b --.

Signed and Sealed this

Eleventh Day of March, 2003

JAMES E. ROGAN
*Director of the United States Patent and Trademark Office*